US010547936B2

(12) United States Patent
Nagel et al.

(10) Patent No.: US 10,547,936 B2
(45) Date of Patent: Jan. 28, 2020

(54) LIGHTING CENTRIC INDOOR LOCATION BASED SERVICE WITH SPEECH-BASED USER INTERFACE

(71) Applicant: ABL IP Holding LLC, Conyers, GA (US)

(72) Inventors: Vernon J. Nagel, Atlanta, GA (US); Jenish S. Kastee, South Riding, VA (US); Jack C. Rains, Jr., Herndon, VA (US); Nathaniel W. Hixon, Arlington, VA (US); Youssef F. Baker, Arlington, VA (US); Daniel M. Megginson, Fairfax, VA (US); Sean P. White, Reston, VA (US); Niels G. Eegholm, Columbia, MD (US)

(73) Assignee: ABL IP HOLDING LLC, Conyers, GA (US)

( * ) Notice: Subject to any disclaimer, the term of this patent is extended or adjusted under 35 U.S.C. 154(b) by 141 days.

(21) Appl. No.: 15/631,441

(22) Filed: Jun. 23, 2017

(65) Prior Publication Data

US 2018/0376243 A1 Dec. 27, 2018

(51) Int. Cl.
*H04R 1/34* (2006.01)
*H04R 25/00* (2006.01)
(Continued)

(52) U.S. Cl.
CPC ..... *H04R 1/34* (2013.01); *H04R 1/028* (2013.01); *H04R 25/40* (2013.01); *H04R 25/405* (2013.01);
(Continued)

(58) Field of Classification Search
CPC ..... G06F 3/013; G06F 3/167; G06F 3/017; G06F 3/0304; G06F 3/041; G06F 3/0484;
(Continued)

(56) References Cited

U.S. PATENT DOCUMENTS 8,128,342 B2 3/2012 Dunn et al.
8,909,382 B1 * 12/2014 Malakuti ..... H05B 37/0227 700/296
(Continued)

OTHER PUBLICATIONS

Politis et al., "Sector-Based Parametric Sound Field Reproduction in the Spherical Harmonic Domain", IEEE Journal of Selected Topics in Signal Processing, 2015, 16 pages.
(Continued)

*Primary Examiner* — Abdelali Serrou
(74) *Attorney, Agent, or Firm* — RatnerPrestia

(57) ABSTRACT

The examples relate to implementations of apparatuses, such as lighting devices, and a system that uses a speech-based user interface to provide speech-based navigation services. The speech-based user interface provides navigation instructions that direct a person to the location of an item within a premises. The person interacts with a speech-based apparatus to receive the navigation instructions as speech-based directions through the premises from a specified location to the item location, or as static navigation instructions enabling the person to navigate from the specified location to the item location. A directional microphone and a controllable speaker receive audio inputs from and output audio outputs to a specified location or subarea of the premises to a person using the speech-based user interface. The audio outputs are directed to the person in the subarea of the premises, and have a higher amplitude within the subarea than outside the subarea of the premises.

29 Claims, 13 Drawing Sheets

(51) Int. Cl.

| | |
|---|---|
| ***H04R 1/02*** | (2006.01) |
| *H04R 1/40* | (2006.01) |
| *H04R 3/12* | (2006.01) |
| *H04R 3/00* | (2006.01) |

(52) U.S. Cl.
CPC ..... *H04R 1/345* (2013.01); *H04R 1/403* (2013.01); *H04R 1/406* (2013.01); *H04R 3/005* (2013.01); *H04R 3/12* (2013.01); *H04R 2201/40* (2013.01); *H04R 2201/401* (2013.01); *H04R 2217/03* (2013.01); *H04R 2430/23* (2013.01)

(58) Field of Classification Search
CPC ..... G06F 3/04883; G06F 3/011; G06F 3/012; G06F 3/04815; G06F 3/0488; G10L 15/22; G10L 15/24; G10L 2015/223; G10L 2015/228; H04L 12/282; H04L 12/2825; H04L 12/2829; H04L 2012/285; H04R 1/34; H04R 25/40; H04R 25/405; H04R 2201/40; H04R 1/403; H04R 1/028; H04R 2430/23; H04R 2217/03; H04R 2201/401; H04R 3/12; H04R 3/005; H04R 1/406; H04R 1/345; G02F 1/133504
See application file for complete search history.

(56) References Cited

U.S. PATENT DOCUMENTS

| | | | | |
|---|---|---|---|---|
| 9,418,115 | B2 * | 8/2016 | Ganick | H04B 10/1149 |
| 9,517,175 | B1 * | 12/2016 | Sisbot | G06K 9/00335 |
| 9,668,080 | B2 * | 5/2017 | Sun | H04R 29/002 |
| 2007/0075898 | A1 * | 4/2007 | Markhovsky | G01S 5/0284 342/386 |
| 2009/0171571 | A1 * | 7/2009 | Son | G01C 21/20 701/532 |
| 2010/0159943 | A1 * | 6/2010 | Salmon | H04W 4/029 455/456.1 |
| 2011/0137881 | A1 * | 6/2011 | Cheng | H04W 4/021 707/706 |
| 2012/0229048 | A1 * | 9/2012 | Archer | H05B 37/0245 315/297 |
| 2013/0026224 | A1 | 1/2013 | Ganick et al. | |
| 2014/0280316 | A1 * | 9/2014 | Ganick | H04B 10/1149 707/769 |
| 2014/0354160 | A1 | 12/2014 | Aggarwal et al. | |
| 2014/0375222 | A1 * | 12/2014 | Rains, Jr. | H05B 37/0245 315/158 |
| 2015/0102745 | A1 * | 4/2015 | Pijlman | H05B 37/0236 315/291 |
| 2015/0130355 | A1 * | 5/2015 | Rains, Jr. | H05B 37/0227 315/134 |
| 2015/0371319 | A1 * | 12/2015 | Argue | G06Q 30/0639 705/26.8 |
| 2016/0335917 | A1 * | 11/2016 | Lydecker | G09B 21/008 |
| 2016/0373269 | A1 * | 12/2016 | Okubo | H04L 12/282 |
| 2017/0134853 | A1 * | 5/2017 | Beaty | H04R 3/005 |
| 2017/0176964 | A1 * | 6/2017 | O'Keeffe | G05B 15/02 |

OTHER PUBLICATIONS

Shi, "Investigation of the steerable parametric loudspeaker based on phased array techniques," Thesis, May 2013, 3 pages.
Pompei, "Sound From Ultrasound: The Parametric Array as an Audible Sound Source", MIT Thesis, Jun. 2002, 132 pages.

* cited by examiner

LIGHTING CENTRIC INDOOR LOCATION BASED SERVICE WITH SPEECH-BASED USER INTERFACE

TECHNICAL FIELD

The present subject matter relates to methods, systems and apparatuses that provide an improved speech-based user interface with a lighting device, for example, for navigational guidance to the location of an item within a space, a part of which is illuminated by the lighting device.

BACKGROUND

The use of voice as an input to a mobile device or computer terminal has become more prevalent as voice recognition systems, such as Siri®, Cortana® Alexa® and Hi Google®, have become easier to use and more accurate with their recognition results. These voice recognition systems may take advantage of positioning systems, such as Global Positioning System (GPS) and positioning systems provided by cellular service providers, and mapping services, such as Google Maps®, to provide outdoor navigation assistance. Information may be provided to the user in audio, e.g., synthesized speech responses, or via the display of the user's device. These examples require that the user has a mobile device or computer terminal at their disposal. In addition, the described systems presume that the user wants to use voice input to their mobile device for navigation purposes which consumes battery life.

Voice-based interfaces have also been used in indoor settings to provide voice-based user commands to lighting devices and other appliances. For example, a lighting device that provides a voice-based interface allowing the user to control the lighting device has been known. A voice based interface also allows the user to obtain information from the Internet, such as stock quotes or sports scores.

SUMMARY

Hence, there is room for further improvement in an apparatus for use as a lighting device or system that incorporates a speech-based user interface for assisting a user in locating items within a premises.

An example of an apparatus includes a general illumination light source, a speech-based user interface, a communication interface, a memory, and a processor. The general illumination light source is configured to emit general illumination light for illuminating a space of a premises. The speech-based user interface includes a microphone with an audio coder that detects speech-related audio inputs from a source of speech, and a controllable speaker with an audio decoder. The speaker is configured to output an audio message in a specified direction toward the source of speech. The communication interface is configured to be coupled to a data network and an application server. The memory stores program instructions and is coupled to the processor. The processor is also coupled to the general illumination light source, the audio coder, the audio decoder, and the communication interface. The processor upon executing the programming instructions stored in the memory configures the apparatus to perform functions. The functions include enabling the microphone and audio coder, and outputting an audio greeting or prompt via the controllable speaker. A record and coded data collection process by the microphone and audio coder that detects speech from a specified location beneath the apparatus is initiated. Coded data is received from the audio coder. The coded data is forwarded, via the communication interface, to a natural language processing service for recognition of the coded data. A recognition result is obtained, via the communication interface, from the natural language processing service. The processor processes the recognition result to identify an item identifier. The item identifier is forwarded, via the communication interface, to an application server. A location of the identified item in the premises and navigation-related information is obtained, via the communication interface, from the application server. The obtained location of the identified item and navigation-related information are encoded into an inquiry response for output.

An example of a method is also described. In the method, a directional microphone of a speech-based user interface is enabled to detect sounds in a subarea beneath a lighting device in an area in which the lighting device is located. The speech-based user interface is incorporated in the lighting device. The detected sound is processed to identify speech-related sound from the subarea. A speech prompt is output, via a speaker of the speech-based user interface. The speech prompt is audible to a person within the subarea, and is output from the speaker as speech that has an audio amplitude higher within the subarea than outside the subarea. Upon receipt of a spoken request output by the directional microphone in response to the speech prompt, a voice recognition process based on the speech prompt is initiated. The spoken request includes an item identifier. In response to an output result of the voice recognition process containing an item identifier, a database containing a location within the premises of the item corresponding to the item identifier is accessed. Based on information in the database, navigation instructions enabling traversal by the person from the subarea to the location of the item within a premises are provided via a speaker of the speech-based user interface. The navigation instructions are provided as speech that has an audio amplitude higher within the subarea than outside the subarea.

An example of a system example is also described that includes a premises-related server, a natural language processing service, and a number of lighting devices. The premises-related server configured to provide information related to identified items within a premises. The natural language processing service provides recognition results in response to receipt of coded speech data, and coupled to communicate with the premises-related server via a data network. The number of lighting devices are coupled to the premises-related server. Each lighting device of the number of lighting devices includes a general illumination light source, a speech-based user interface, a communication interface, a memory, and a processor. The general illumination light source is configured to emit general illumination light for illuminating an area of a premises. The speech-based user interface includes a microphone coupled to an audio coder that detects speech-related audio inputs from a source of speech and a controllable speaker coupled to an audio decoder. The speaker is configured to output an audio message in a specified direction for presentation to the source of speech. The communication interface is configured to enable communications of the respective lighting device via the data network. The processor is coupled to the general illumination light source, the audio coder, the audio decoder, the communication interface, and the memory. The processor upon executing the programming instructions stored in the memory configures the lighting device to perform functions. The functions include monitoring coded speech-related sound data provided by the audio coder based on speech-related sound detected by the microphone. Upon identification of encoded speech-related sound data representing a spoken keyword, a source localization process is performed that identifies within the area, a subarea from which the spoken keyword originated. A primary lighting device of the number of lighting devices is identified as being closest to the subarea. In response to the identification of the primary lighting device, responsibility is established for further processing by the primary lighting device. The processor of the primary lighting device is further configured to, in response to the source localization process, identify the subarea, initiate a record and coded data collection process by the microphone and audio coder of the primary lighting device that detects speech from the identified subarea. Coded speech data based on speech originating from the identified subarea is received from the audio coder of the primary lighting device. The coded speech data is forwarded via the communication interface of the primary lighting device to the natural language processing service. A recognition result from the natural language processing service is obtained via the communication interface of the primary lighting device. The recognition result is processed to identify an item identifier. The item identifier is forwarded to the premises-related server via the communication interface of the primary lighting device. A location of the identified item in the premises is obtained from the premises-related server via the communication interface of the primary lighting device. The obtained location with item and location-related data are encoded as an inquiry response for output by the speaker of the primary lighting device. The encoded inquiry response includes an encoded audio response message for output as speech. Audio directional control signals to configure the controllable speaker of the primary lighting device determined to output speech substantially limited to the identified subarea. The encoded inquiry response is forwarded to the audio decoder coupled to the speaker of the primary lighting device. The audio decoder decodes the encoded inquiry response. An audio output generated by the speaker of the primary lighting device includes speech based on the decoded inquiry response and the audio directional control signals. The generated audio output is being substantially limited to the identified subarea of the premises.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations by way of example only, not by way of limitations. In the figures, like reference numerals refer to the same or similar elements.

FIG. 2 illustrates an example of system level arrangement that includes functional block diagram of an example apparatus including system elements of a speech-based user interface for the indoor navigation and information services as well as a light source for general illumination or the like.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Reference now is made in detail to the examples illustrated in the accompanying drawings and discussed below.

Figure 1:
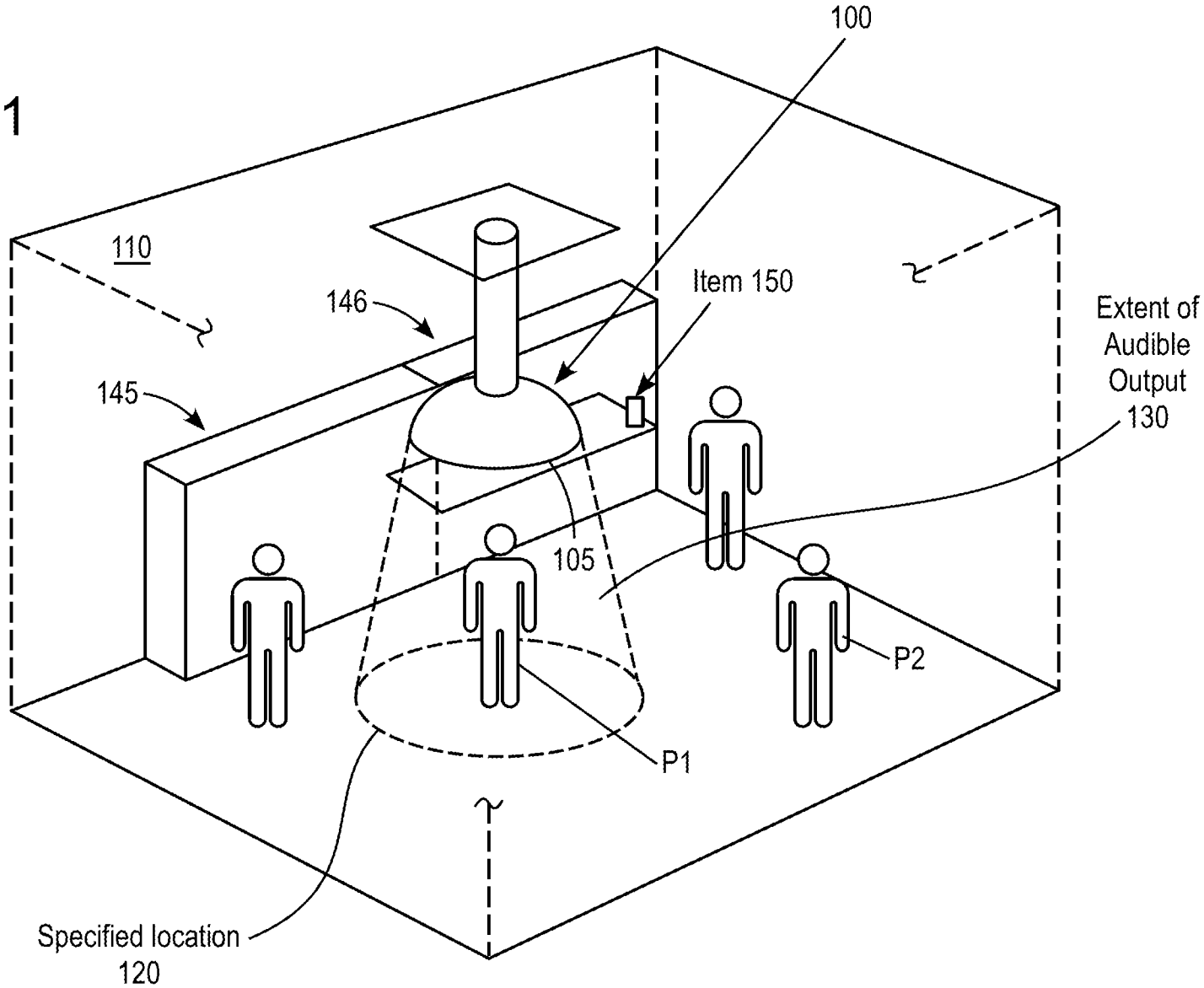
FIG. 1 illustrates a view of part of a premises having an example of an apparatus incorporating a light source as well as a speech-based user interface for indoor navigation and information services.

FIG. 1 illustrates a view of part of a premises in which an example of an apparatus incorporating a speech-based user interface to offer an indoor navigation and information services may be located. In addition to the navigational information provided by the indoor navigation service, the speech-based user interface may offer information services related to items related to the premises. For example, the information services may provide information such as internal product information, such as price, stock, ratings, or external general information, such as nutrition value, ingredients, how the item is made, where it is made, and the like. The apparatus 100 may be a lighting device configured with a speech-based user interface. The apparatus 100 may be located in a premises 110. The premises 110 may be a retail location, a convention center, a grocery store, a warehouse, a shopping mall, a vestibule and/or food service areas of a stadium or any other location that would benefit from being equipped with an apparatus incorporating a speech-based user interface and/or may benefit from the indoor navigation service. For example, the premises 110 may include bays 145 and 146. The bays 145 and 146 may be configured to hold items, such as 150, in the inventory of items held in the premises 110. The apparatus 100 may be located for example at the entrance of the premises 110 to provide persons, such as P1 and P2, with the opportunity to interact via a speech-based user interface (not shown in this example) with the apparatus 100. The speech-based user interface of the apparatus 100 includes a microphone, a speaker, and other circuitry that will be described in more detail with respect to other examples. A "user interface" as described herein includes one or more audio/electrical transducers of a type to enable audible speech input and audible speech output. Such audio interface hardware enables a user to make spoken inputs to a machine that executes machine readable code to process the inputs and enables the machine to output a result of the processing for presentation to the user. The inputs, in the particular examples, may typically be speech-based inputs. The outputs, however, may be audio outputs, graphical outputs or both.

In the example, the apparatus 100 may have a covering 105 that distinguishes the apparatus 100 from other devices, including other lighting devices in the premises. In addition to the covering 105 or as an alternative to the covering 105, the apparatus 100 may include a general illumination light source (described in more detail with reference to another example) that illuminates the specified location 120 to indicate to a person, such as P1, where to stand to use the speech-based user interface on the apparatus 100. The specified location 120 may, for example, be a preselected subarea within the premises 110. The apparatus 100 may be tuned to interact with a person, such as P1, standing at the specified location 120; therefore, the apparatus 100 may not respond to speech from persons, such as P2, that are outside the specified location 120. When person P1 moves into the specified location 120, the apparatus 100 as will be explained in more detail with reference to another example, may generate an audio prompt that is directed to and intended to be heard by a person, such as P1, within the extent of the apparatus' audible output 130. For example, when person P1 is interacting with the speech-based user interface of the apparatus 100, the person P2 is not intended to hear any audio messages output by the apparatus 100 because person P2 is outside the extent of the audible output 130.

An example of a configuration of an apparatus, such as 100, will be described in more detail with reference to FIG. 2. The system 10 illustrated in FIG. 2 includes one or more apparatuses 200, a premises server 275, system database 276, data communication network 277, a data network 295, and a mobile device 297. Some apparatuses 200 may include multiple interfaces to the data communication network(s) 227; and or some apparatuses 200 may include interfaces for communication with other equipment in the vicinity. In the example, the system 10 may be installed at a premises, such as 110. The data communication network 227 may interconnect with the links to/from the communication interface 241 of the apparatus 200, so as to provide data communications to the apparatus 200 and the premises server 275. The data communication network 277 may also enable wireless connections via a wireless access point 278 with mobile devices such as 297. The premises server 275 is coupled to the system database 276. The data communication network 277 may be wired (e.g. metallic or optical fiber), wireless (e.g. radio frequency or free space optical), or a combination of such network technologies. The data communication network 227 also is configured to provide data communications for the premises server 275 via a data network 295 outside the premises, shown by way of example as a wide area network (WAN) 295, so as to allow the apparatus or other elements/equipment at the premises 110 to communicate with outside devices such as the natural language processing (NPL) service 282. The wider area network 295 outside the premises, may be an intranet or the Internet, for example. The NLP service may be a cloud-based service or provided as a server coupled to the wide area network 295.

Figure 2:
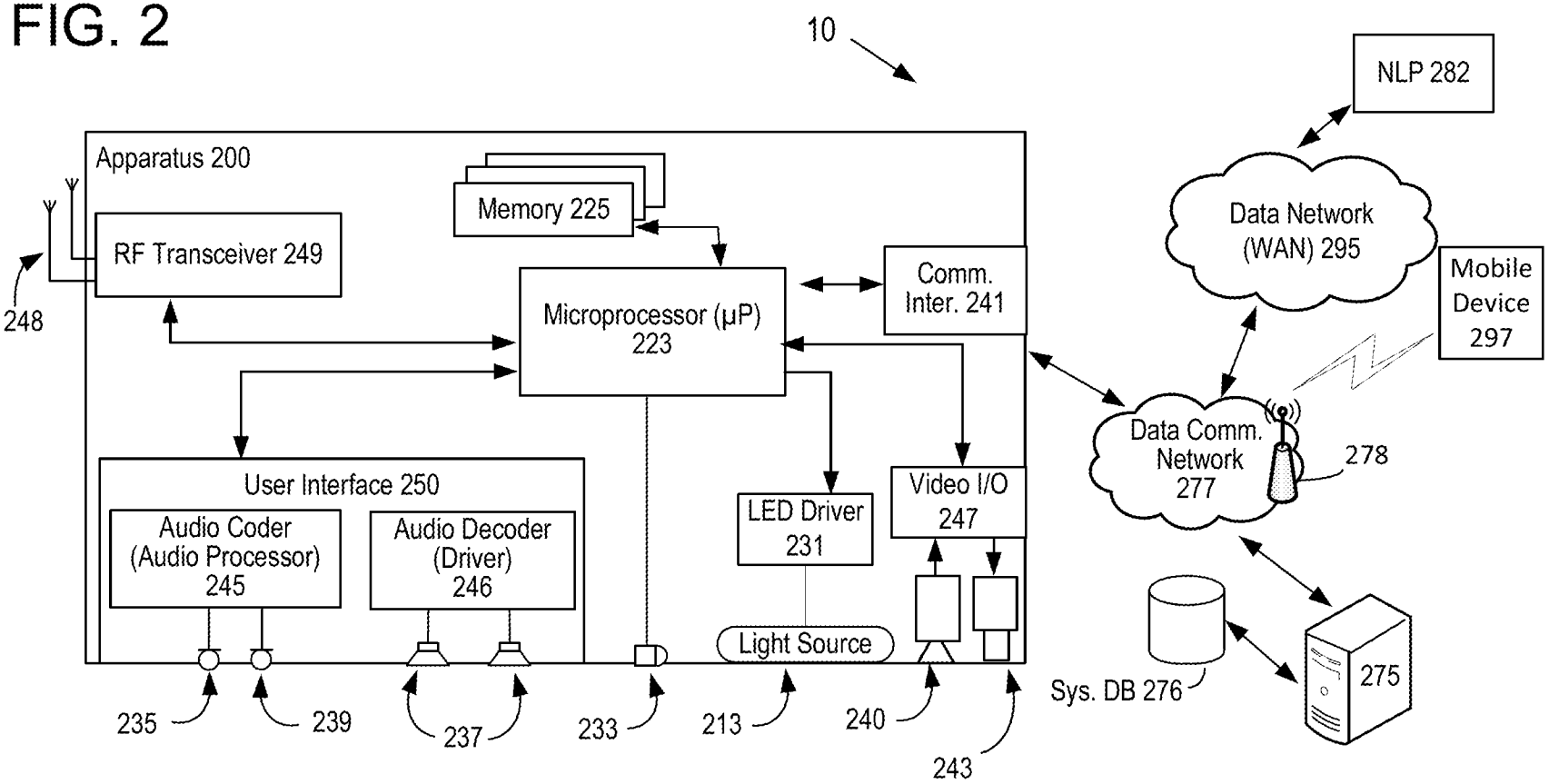

In the example of FIG. 2, an implementation of an apparatus 200 includes a speech-based user interface 250 controlled by a processor. The processor may be a microcontroller or other circuitry for implementing a programmable central processing unit. In the example, the processor is a microprocessor (μP) 223.

At a high level, the apparatus 200 may be a lighting fixture or other type of lighting device. As described in the following examples, the apparatus 200 includes a general illumination light source 213, the processor 223, one or more memories 225, a communication interface 241, a microphone(s) 235, 239, and a speaker(s) 237; and the apparatus 200 may include one or more sensors, such as a person detection sensor 233.

As noted, an example of an implementation of the processor is the microprocessor (μP) 223, which serves as the programmable central processing unit of the apparatus 200. The μP 223, for example, may be a type of device similar to microprocessors used in servers, in personal computers or in tablet computers, or in smartphones, or in other general purpose computerized devices. Although the drawing shows a single μP 223, for convenience, the apparatus 200 may use a multi-processor architecture. The μP 223 in the example is of a type configured to communicate data at relatively high speeds via one or more standardized interface buses (not shown).

Typical examples of memories 225 include read only memory (ROM), random access memory (RAM), flash memory, a hard drive, and the like. In this example, the memory or memories 225 store executable programming for the μP 223 as well as data for processing by or resulting from processing of the μP 223.

The example apparatus 200 is a lighting device and therefore, includes a light source, e.g. a set of light emitting diodes 213. The source 213 may be in an existing light fixture or other lighting device coupled to the other device components, or the source 213 may be an incorporated source, e.g. as might be used in a new design or installation. The source 213 may be a general illumination light source configured to emit general illumination light for illuminating a space of a premises. For example, the source 213 may be any type of light source that is suitable to the general illumination application (e.g. task lighting, broad area lighting, object or personnel illumination, information luminance, etc.) desired for the space or area in which the particular apparatus 200 is or will be operated. Although the source 213 in the apparatus 200 may be any suitable type of light source, many such devices will utilize the most modern and efficient sources available, such as solid state light sources, e.g. LED type light sources.

Power is supplied to the light source 213 by an appropriate driver 231. The source driver 231 may be a simple switch controlled by the processor of the device 200, for example, if the source 213 is an incandescent bulb or the like that can be driven directly from the AC current. Power for the apparatus 200 is provided by a power supply circuit (not shown) which supplies appropriate voltage(s)/current(s) to the source driver 231 to power the light source 213 as well as to the components of the device 200. Since the source 213 is shown as LEDs, for example, the driver would be a corresponding type of LED driver as shown at 231. Although not shown, the apparatus 200 may have or connect to a back-up battery or other back-up power source to supply power for some period of time in the event of an interruption of power from the AC mains.

The source driver circuit 231 receives a control signal as an input from the processor 223 of the device 200, to at least turn the source 213 ON/OFF. Depending on the particular type of source 213 and associated driver 231, the processor input may control other characteristics of the source operation, such as dimming of the light output, pulsing of the light output to/from different intensity levels, color characteristics of the light output, or the like. These functions may be used to get the attention of a person and/or indicate the specified location, such as 120.

The apparatus 200 also includes one or more communication interfaces 241. The communication interfaces at least include an interface configured to provide two way data communication for the μP (and thus for the device 200) via a data communication network 227. In the example of FIG. 2, the interface 241 provides the communication link to the data communications network 227 enables the μP 223 to send and receive digital data communications through the particular data communications network 23.

An apparatus like 100 in the FIG. 1 example may have one or more user input sensors, such as microphone 235 and/or a person detection sensor 233 configured to detect user activity. The example apparatus 200 also includes one or more output components configured to provide information output to the user, such as one or more speakers 237. For example, the person detection sensor 233 may be responsive to a person in a subarea, such as specified location 120 or the like, of an area in the vicinity of the apparatus 200. Although the input and output elements and/or such elements of different types, for convenience, the apparatus 200 shown in FIG. 2 includes both input and output components as well as examples of several types of such components.

In the example, the apparatus 200 has a speech-based user interface 250 that includes a number of microphones such as 235, 239, an audio coder (processor) 245, one or more speakers 237 and an audio decoder (driver) 246. The number of microphones 235, 239 are configured for detection of speech-related sound and to support associated signal processing to determine direction of detected speech-related sound. For ease of discussion, the description refers to two microphones 235, 239 but more or less microphones may be used depending upon the implementation. Examples of microphones that may be used with the apparatus 200 include digital/analog-type, micro-electro-mechanical system (MEMS), condenser, optical microphones or the like. For example, the microphones 235, 239 with the audio coder or audio processor, 245 may detect speech-related audio inputs from a source of speech, such as a person, a person with a speech synthesizer or robot. For example, the signal processing techniques relate to phase delay of signals from multiple microphones for beamforming (e.g. for directional sound pickup), source localization, blind source separation (to identify and/or characterize different sounds received by the number of microphones 235, 239), and to selectively accept only the desired speech-related sound signal. The apparatus 200 in this example also includes a radio frequency (RF) transceiver, such as 249. The RF transceiver 249 may detect the presence of a mobile phone in the specified location, such as 120, by detecting one or more of a cellular radio frequency, a Bluetooth frequency, or a Wi-Fi frequency. The RF transceiver 249 may also be used to communicate with the mobile device 297 (e.g. via Bluetooth or Wi-Fi) in the specified location or a subarea of the premises. In another example, the apparatus 200 may output ultrasonic encoded signals that are detectable by the mobile device 297. For example, the mobile device 297 microphone and speaker may be configured to respectively detect and output sound in the ultrasonic frequency range. Alternatively, the mobile device 297 may be coupled to a device that detects and outputs audio frequencies in the ultrasonic range In order to avoid detecting mobile phones of persons other than the user of the apparatus 200, the RF transceiver 249 and antenna 248 may be configured with a low gain setting or the like such that any signals transmitted by the RF transceiver 249 are attenuated outside the specified location and do not have sufficient power for reception by a mobile device outside the specified location or subarea. Alternatively, or in addition, the radio frequency transceiver is configured to emit signals at a power setting at which the power of the emitted signals is higher in the specified location or subarea than outside the specified location or subarea. In the space encompassed by the specified location or subarea, the transmit power of the radio frequency transceiver is sufficiently high to normally be received by a mobile device currently within that space. In contrast, in a space outside the specified location or subarea the transmit power of the radio frequency transceiver is sufficiently low that it normally would not be received with sufficient signal strength to be detectable by a mobile device in the space. Alternatively, or in addition, the RF transceiver 249 may utilize an antenna array, such as 248 to shape the radio frequency beam output from the RF transceiver 249 to only transmit and receive in an area substantially within and/or not extending much beyond the specified location.

In the example, the speech-based user interface 250 of the apparatus 200 also includes an audio output component such as one or more speakers 237 configured to provide information output to the user. The one or more speakers 237 may be controllable speakers coupled to an audio decoder or driver, such as 246. The controllable speakers 237 output audio, and are controllable to direct the output audio in a specified direction, in this example for presentation to the source of speech detected via the microphone 235 and/or 239. For example, the speakers 237 may be phased array speakers controllable to output audio that is directed to a person in the specified location 120, and the outputted audio has an amplitude that is higher within the specified location than outside the specified location. In the space encompassed by the specified location 120, the amplitude is sufficiently high to normally be heard by a person currently within that space. In contrast, in a space outside the specified location the amplitude is sufficiently low that it normally would not be heard by a person currently within that space. Alternatively, or in addition, the speakers 237 or additional speakers at, for example, the perimeter the apparatus may be configured to output sound that provides destructive interference. The apparatus may be configured such that the destructive interference occurs at the ears of the person standing outside the specified location to achieve absolute cancellation. For example, the processor 223 and the person detection sensor 233 may be configured to enable tracking of a person immediately outside the specified location and acquire an approximation height of the person. Using this information, the processor may control the speakers 237 or the additional speakers to deliver phase delayed sound directly to the ears of the person outside the specified area. The apparatus 200 may be equipped with additional directional speakers that point outward, away from the covering, such as 105 of FIG. 1, of the apparatus that may cause destructive interference, but to a lesser extent. The simpler approach may provide adequate attenuation, but not necessarily complete noise cancellation.

The example apparatus 200 utilizes an audio input circuit that is or includes an audio coder or processor, as shown at 245. The audio coder 245 converts an audio responsive analog signal from the microphone 235 to a digital format and supplies the digital audio to the μP 223 for processing and/or to a memory 225 for temporary storage. The audio coder 245 may also be an audio processor configured to perform tasks such as audio conditioning and noise cancellation. Conversely, the audio decoder 246 receives digitized audio via the bus and converts the digitized audio to an analog signal which the audio decoder 246 outputs to drive the speaker 237. The audio decoder 246 may also receive audio directional control signals to cause the decoder/driver 246 to configure the controllable speakers 237 to output speech substantially limited to an identified subarea of the premises, such as the specified location 120. "Speech" is an analog audio sound that includes spoken/verbal information for human communication. The speakers 237 may be one or more of various types of directional speakers, i.e., speakers that direct sound, such as speech, in a narrow path to a specified location within the premises in which the directed sound has an amplitude higher within the specified location than outside the specified location such that the directed sound is substantially limited to the specific location. The signals to directionalize audio output may be actual signals to adjust aspects of speaker operation; or in a speaker array arrangement, the signals to directionalize audio output may be variations in parameters (e.g., phase and amplitude) superimposed on actual analog audio output signals going from the driver 246 to the speaker components of the array.

The speakers 237 of the speech-based user interface 250 may be of various types of controllable audio output, or audio reproduction, devices. For example, the speaker 237 may be a steerable ultrasonic array that enables sound to be targeted to a relatively small area, such as those described in a MIT thesis paper available at dspace.mit.edu/handle/1721.1/7987 or, for example in U.S. Pat. No. 8,128,342 B2. For example, the audio decoder or parametric speaker driver may be configured to be responsive to an audio message and audio directional control signals. The speaker 237 generates an audio message by outputting component ultrasonic sounds that when combined form speech that is directed, based on the audio directional control signals, to a subarea of an area in proximity to the apparatus 200. The generated audio message is intended, by this directional output to be audible as speech in the subarea, and the speech has a higher amplitude within the subarea than outside the subarea. The subarea may be, for example, the specified location 120 in FIG. 1; however, in other examples, the subarea may be any area within a premises from which a source of speech is detected by the microphone 235. Alternatively, the speaker 237 may be a parametric speaker that is configured to output an audio message as speech based on audio directional control signals. The audio directional control signals are passed through to the speaker to configure the parametric speaker to direct the outputted speech to the subarea of the area in proximity to the apparatus. Specific examples of such sound reproduction using parametric speakers has been discussed by others; therefore, the details of which are not included in this disclosure.

In the example, the apparatus 200 may optionally include a camera 240, configured to detect visible user input activity, from which may be ascertained user disposition (e.g., frustration, amazement or the like), user age, or the like. For example, the person using the speech-based navigation service may be a hearing-impaired person, in which case the camera 240 may be used to assist in identifying the hearing-impaired person based on recognizing an approximate age of the person (e.g., an older person is more apt to have a hearing impairment). The apparatus 200 may also have an image (still or video) output component such as a projector 243, or a display in a software configurable lighting device as described in U.S. patent application Ser. No. 15/244,402 which published as US 2017/00618904, the disclosure of which is incorporated herein by reference in its entirety. The display or image output component, such as projector 243, may be configured to provide information, such as navigation results, output to the user in a visual format in the form of, for example, a directional indicator (e.g. arrow or the like), a premises map with item location indicators, for example, on the floor in or near the specified location 120 of FIG. 1 or the like. The image output component provided by the projector 236 may be used to supplement the audio output or replace the audio output depending upon the implementation. The apparatus 200 may also include appropriate input signal processing circuitry and video driver circuitry, for example, as shown in the form of video input/output (I/O) circuitry 247. The connection of the video I/O circuitry to either one or both of the camera 240 and the projector 243 could be analog or digital, depending on the particular type of camera and projector. The video I/O circuitry 247 may also provide conversion(s) between image data format(s) used on the bus and by the μP 223 and the data or analog signal formats used by the camera 240 and the projector 243.

The actual user interface elements, e.g. speaker 237 and/or microphone 235, may be in the apparatus 200 or may be outside the apparatus 200 with some other link to a lighting fixture. If outside the apparatus 200, the link may be a hard media (wire or fiber) or a wireless media.

For example, the apparatus 200 and/or the system 10 can incorporate a voice recognition/command type interface via a lighting device and a network to obtain information, to access item location and premises navigation applications/functions, etc. For example, a user in the lighted space can ask questions related to location information of items held in inventory in the premises by speaking the questions. The system 10, as will be explained in more detail with reference to the other examples, is configured to provide, in response to item location questions received by the microphone 235, navigation-related information relevant to the item location to the user. It may be appropriate at this time to describe a couple specific examples of an apparatus 200.

Figure 3:
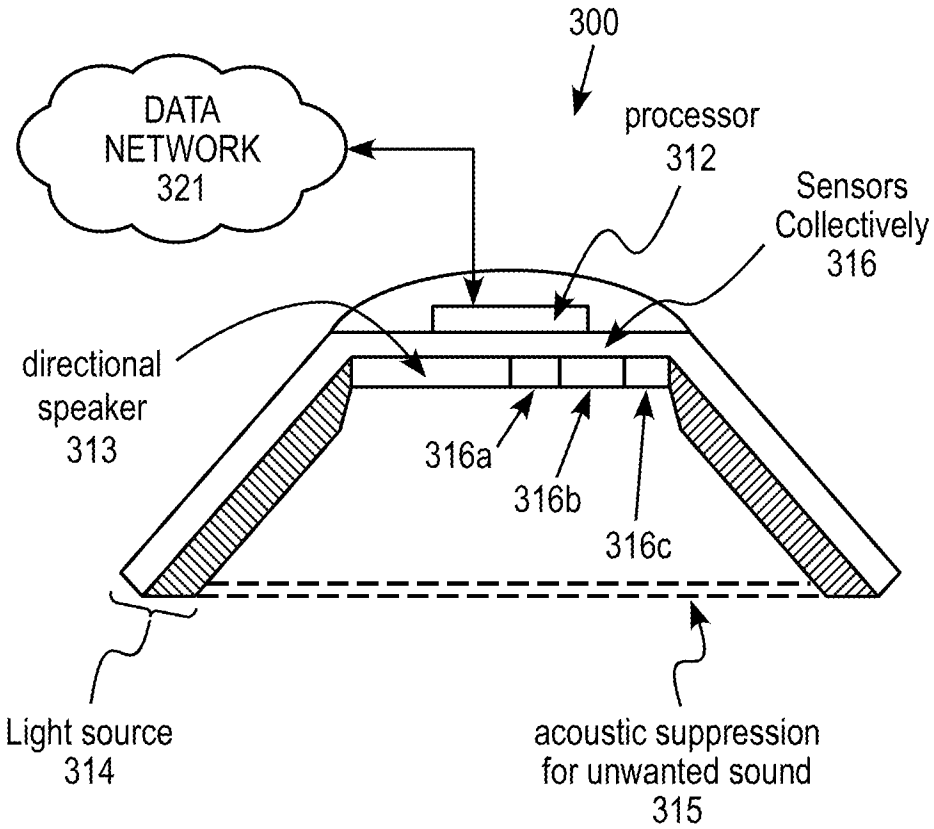
FIG. 3 illustrates a cross-sectional view of an example of an apparatus usable in the premises example illustrated in FIG. 1.

The example of FIG. 3 provides an apparatus incorporating a user interface to a navigation-related service for locating items within a premises. The apparatus 300 includes a light source 314, a directional speaker 313, a processor 312, sensors ("collectively") 316 and acoustic suppression 315. The acoustic suppression 315 is useful to attenuate unwanted sounds from outside the area, such as the specified location 120 of FIG. 1, from which the apparatus 300 is intended to receive speech-based inputs. The light source 314 may be configured to emit general illumination light for illuminating a space of a premises. The sensors 316 are shown collectively, but may include one or more of a microphone 316*a*, a person detection sensor 316*b*, a mobile phone detection circuits 316*c*, or the like. The microphone 316*a*, as mentioned above with reference to the example of FIG. 2, is part of a speech-based user interface with the directional speaker 313, detects speech-related audio inputs from a source of speech. The person detection sensor 316*b* is responsive to a person in the subarea of an area in the vicinity of the apparatus. The mobile phone detector circuits 316*c* may be radio frequency transceiver, such as a cellular transceiver, a Bluetooth transceiver and/or a Wi-Fi transceiver. The controllable directional speaker 313 with an audio decoder outputs an audio in a specified direction for presentation to the source of speech. A communication interface (not shown in this example) may be coupled to a data network 321. The processor 312 is coupled to the light source 314, the audio coder (not shown) of the microphone 316*a*, the audio decoder (not shown) of the directional speaker 313, and the person detection sensor 316*b*. The processor 312 upon executing the programming instructions stored in a memory configures the apparatus to perform functions as will be described with reference to other examples.

Figure 4A:
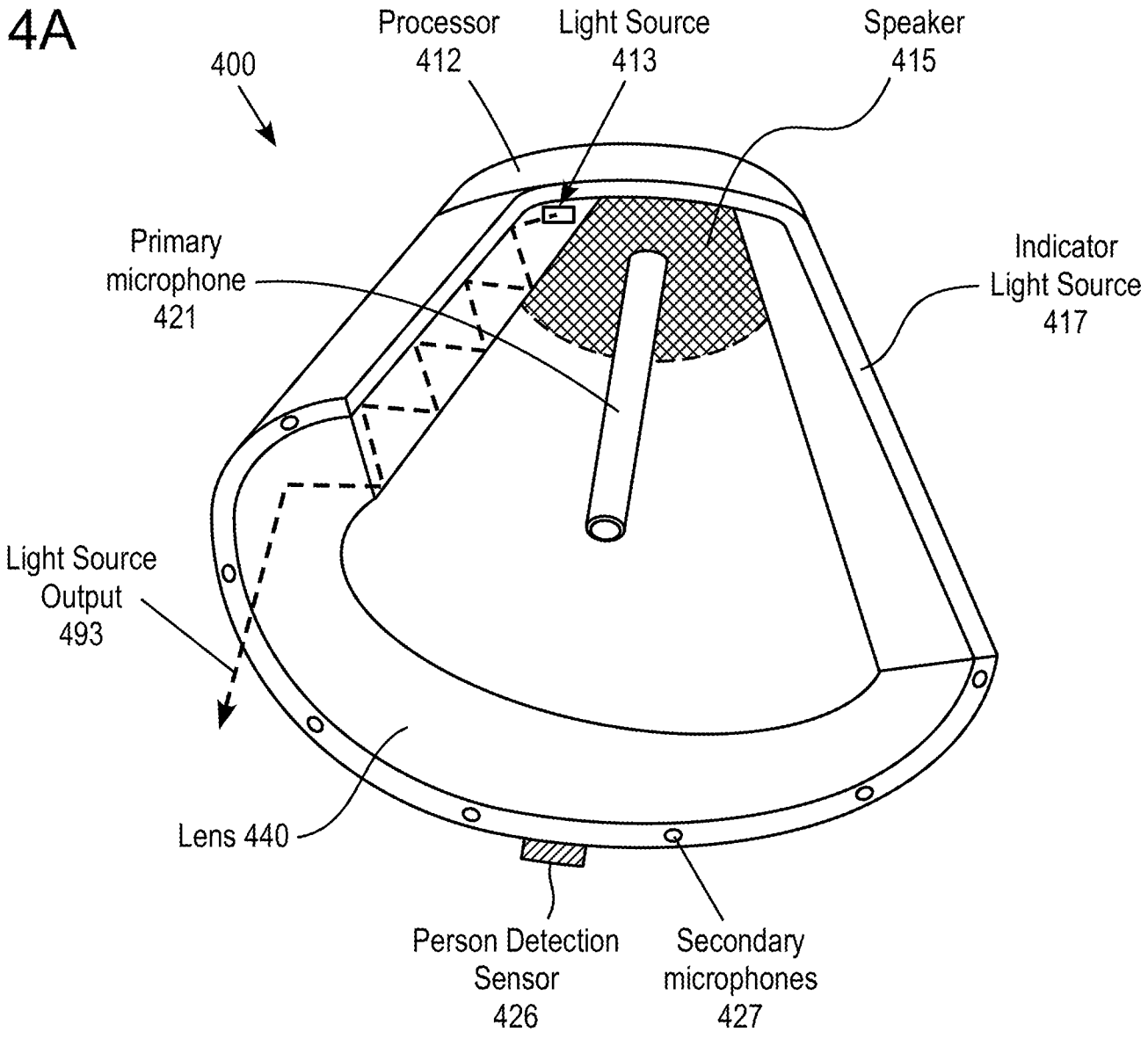
FIG. 4A illustrates a cross-sectional view of another example of an apparatus incorporating a speech-based user interface usable in the premises example illustrated in FIG. 1.

FIG. 4A illustrates a cross-sectional view of another example of an apparatus incorporating a speech-based user interface for use in a system, such as that shown in FIG. 1. The apparatus 400 includes substantially similar components as the apparatus 300. For example, the apparatus 400 includes a processor 412, a light source 413, a speaker 415, an indicator light source 417, a primary microphone 421, secondary microphones 427, a person detection sensor 426 and a lens 440. A speech-based user interface includes the primary microphone 421, secondary microphones 427 and a speaker 415. In the example, the apparatus 400 has a light source 413 that produces general illumination that is output as light source output 493 through the lens 440. The lens 440 may be a diffuser or other optical lens that may or may not provide some effect, such as diffusion or beam shaping, to the outputted general illumination light. The speaker 415 is configured to direct sound toward a subarea, such as a specified location beneath the apparatus 400, such that the sound is directed to a person in the subarea, and has an amplitude higher within the specified location than outside the specified location, such as 120 of FIG. 1. The speaker 415 may be a parametric speaker that may include an ultrasonic transducer array as described above. The primary microphone 421 may be a hypercardioid directional microphone that detects sounds from a specified location, such as specified location 120. The secondary microphones 427 are external to the apparatus 400 and are configured to enhance the directionality of the primary microphone 421 by providing inputs for the calculation of noise and echo cancellation when the primary microphone 421 is receiving speech-based input from a source of speech, such as a person. The apparatus 400 is shown as being cone shaped and as such may be installed to be angled toward a particular area that may be, for example, off center from the point at which the apparatus is installed. The term "beneath" may encompass areas that are in the line-of-sight of the primary microphone 421 as well as areas that are directly below the apparatus 400.

The apparatus 400 in the example of FIG. 4A includes the indicator light source 417, the primary microphone 421 and the secondary microphones 427. The primary microphone 421 and the secondary microphones 427 are coupled as a speech-based user interface. The indicator light 417 may be a light source that flashes or emits light of a color different than the general illumination light of the area of the premises. For example, the indicator light 417 may be red, orange, green, blue or may even be a combination of different colors. A purpose of the indicator light 417 is to attract the attention of persons in the premises whom wish to utilize the speech-based, navigation-related services provided via the primary microphone 421 and the secondary microphones 427 of a speech-based user interface of apparatus 400. The indicator light 417 may be coupled to and controlled by the processor 412. In one example, the indicator light 417 may continuously flash to indicate the apparatus' location. Alternatively, under control of the processor 412, the indicator light 417 may only be illuminated by the processor 412 in response a signal from the person detection sensor 426. Although not shown, are coupled to an audio coder or an audio processor, which processes sound data based on the input signals from the primary microphone 421 and the secondary microphones 427 to provide the noise and echo cancellation.

Figure 4B:
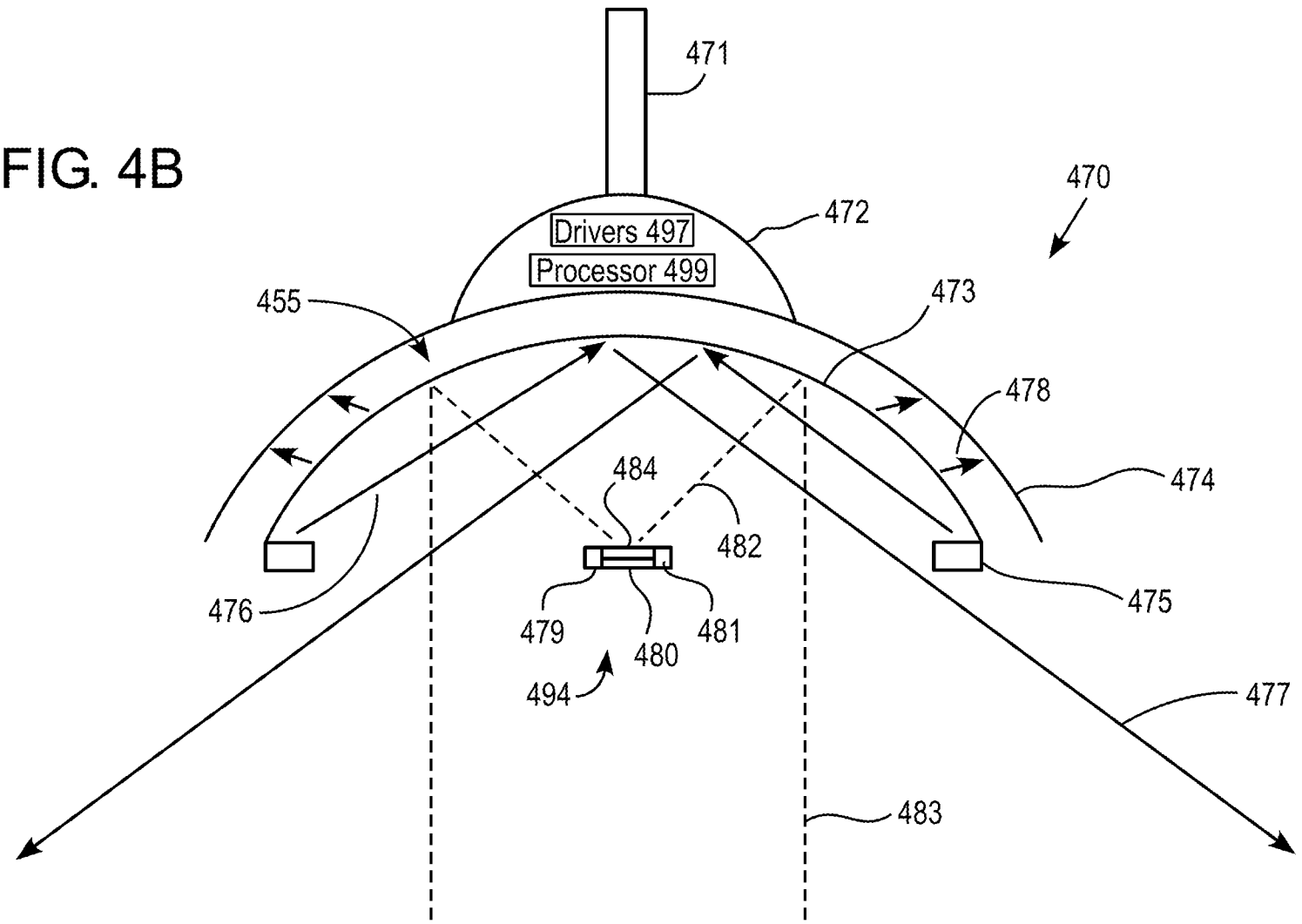
FIG. 4B illustrates a cross-sectional view of yet another example of an apparatus incorporating a speech-based user interface for use in a system, such as that shown in FIG. 1.

FIG. 4B illustrates a cross-sectional view of yet another example of an apparatus incorporating a speech-based user interface for use in a system, such as that shown in FIG. 1. The apparatus 470 includes substantially similar components as the apparatuses 300 and 400. For example, the apparatus 470 includes a processor 499, a reflector dish 473, a light source 475, a speaker 481, an indicator light source 478, a speaker 479, a microphone 480, a person detection sensor 426 and an external dish 474. In this example, the speech-based user interface 494 includes the microphone 480 and a speaker 481. In the example of FIG. 4B, the apparatus 470 includes a hoist 471, a housing 472 for the circuitry comprising lighting and speaker drivers 497 and the processor 472. The reflector dish 473 may be coupled to the interior of an external dish 474, and is configured to reflect both light and sound. The external dish 474 may be a diffuser or other optical lens that may or may not provide some effect, such as diffusion or beam shaping, to the outputted tunable color indicator light 478. The apparatus includes a light source 475 that emits general illumination light 476 into the reflector dish 473 that is output as reflected light 477. The speaker 481 is configured to direct sound 482 upwards into reflector dish 473, which may be, for example, parabolic as shown in the figure, another shape, faceted or a combination of shapes. The sound 482 output from the speaker is reflected by the reflector dish 473 and reflected as reflected sound 483 toward a subarea, such as a specified location, such as 120 of FIG. 1, beneath the apparatus 470. The reflected sound 483 is directed to a person in the subarea, and has an amplitude higher within the specified location than outside the specified location. In some examples, the microphone or microphone array 480 may face downward away from reflector dish 473 to detect sound from the vicinity of the apparatus 470. Alternatively, the microphone or microphone array 480 may face upward to take advantage of sound collection properties of the parabolic reflector dish 473 while detecting sound from the vicinity of the apparatus 470. Additional light sources (not shown in this example) may be positioned in a space 455. Based on inputs, for example, from the person detection sensor 481 or mobile device detection circuits 479, the processor 499 may control the additional light sources to emit colored light, flashing light, multi-colored light or the like to indicate the location of the apparatus 470 to a user, that the apparatus 470 is in use, or the apparatus 470 is ready to be used. For ease of illustration, some of the structures, such as those holding the speech-based interface 494 in place are not shown.

It may be appropriate at this time to discuss a process example that may be performed using the apparatus examples described with reference to FIGS. 1-4B.

Figure 5A:
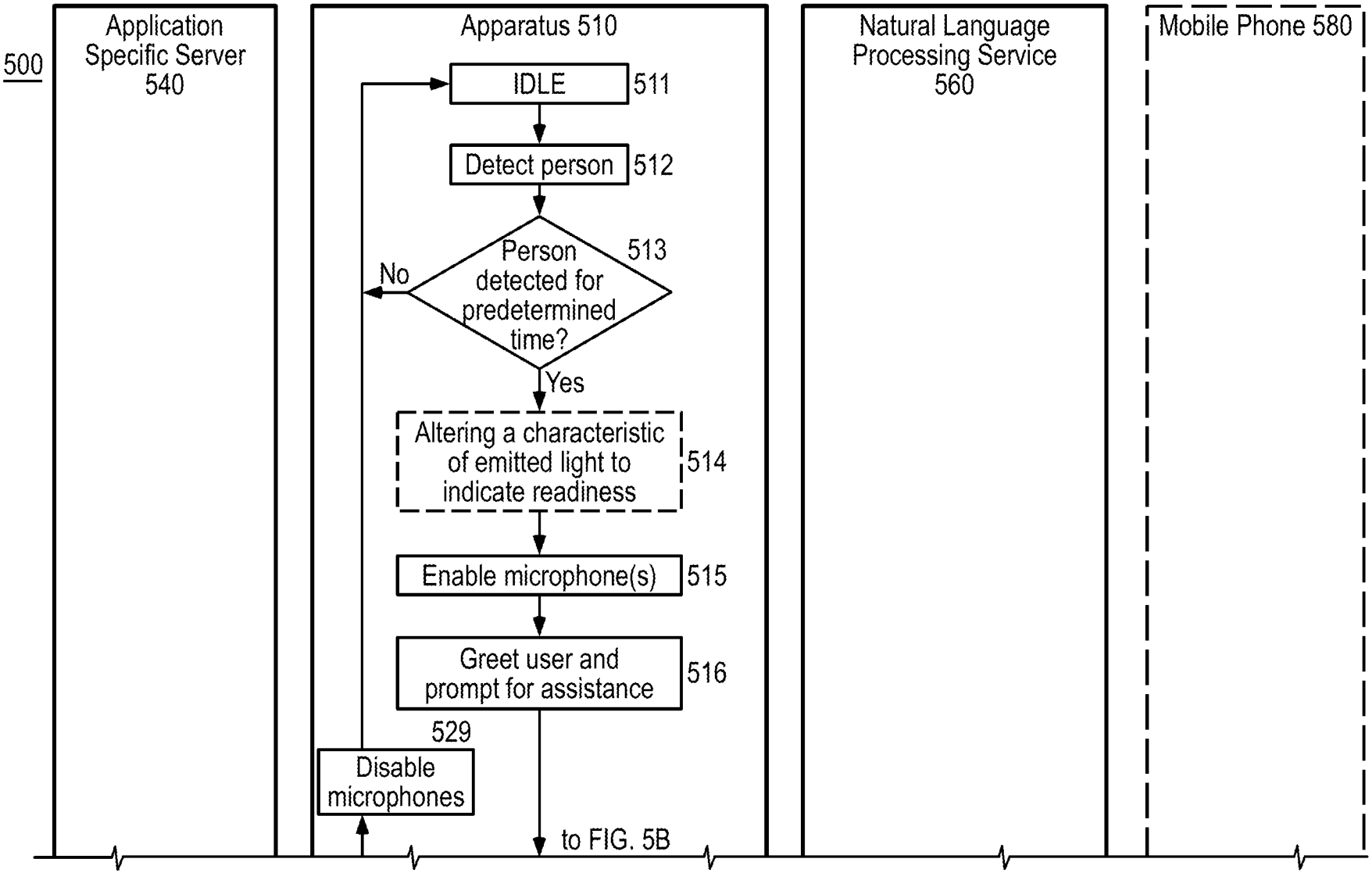
FIGS. 5A, 5B and 5C provide a flowchart of an example process utilizing a speech-based user interface for an indoor navigation service executable by the apparatuses described with reference to FIGS. 1-4B.
Figure 5B:
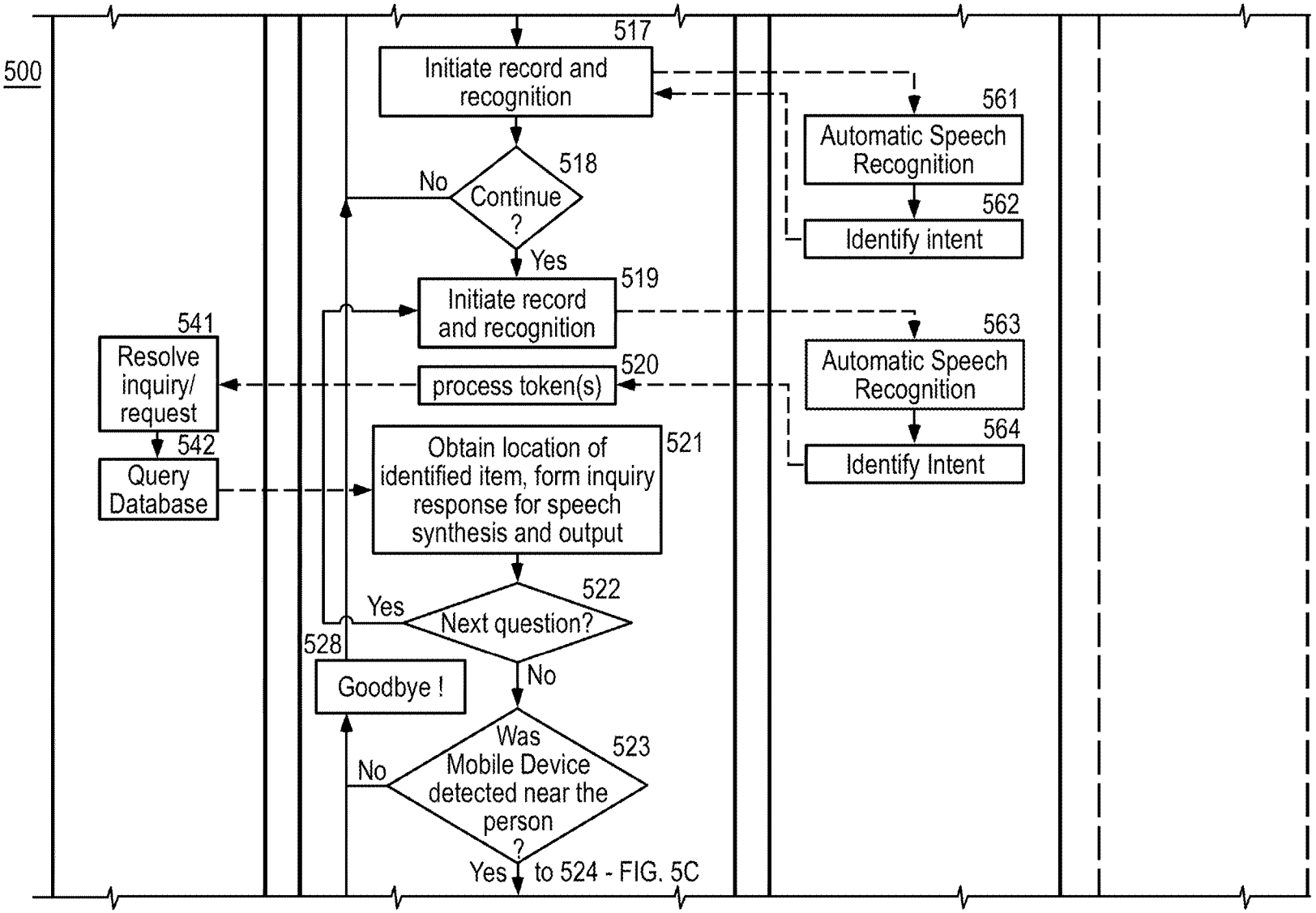
Figure 5C:
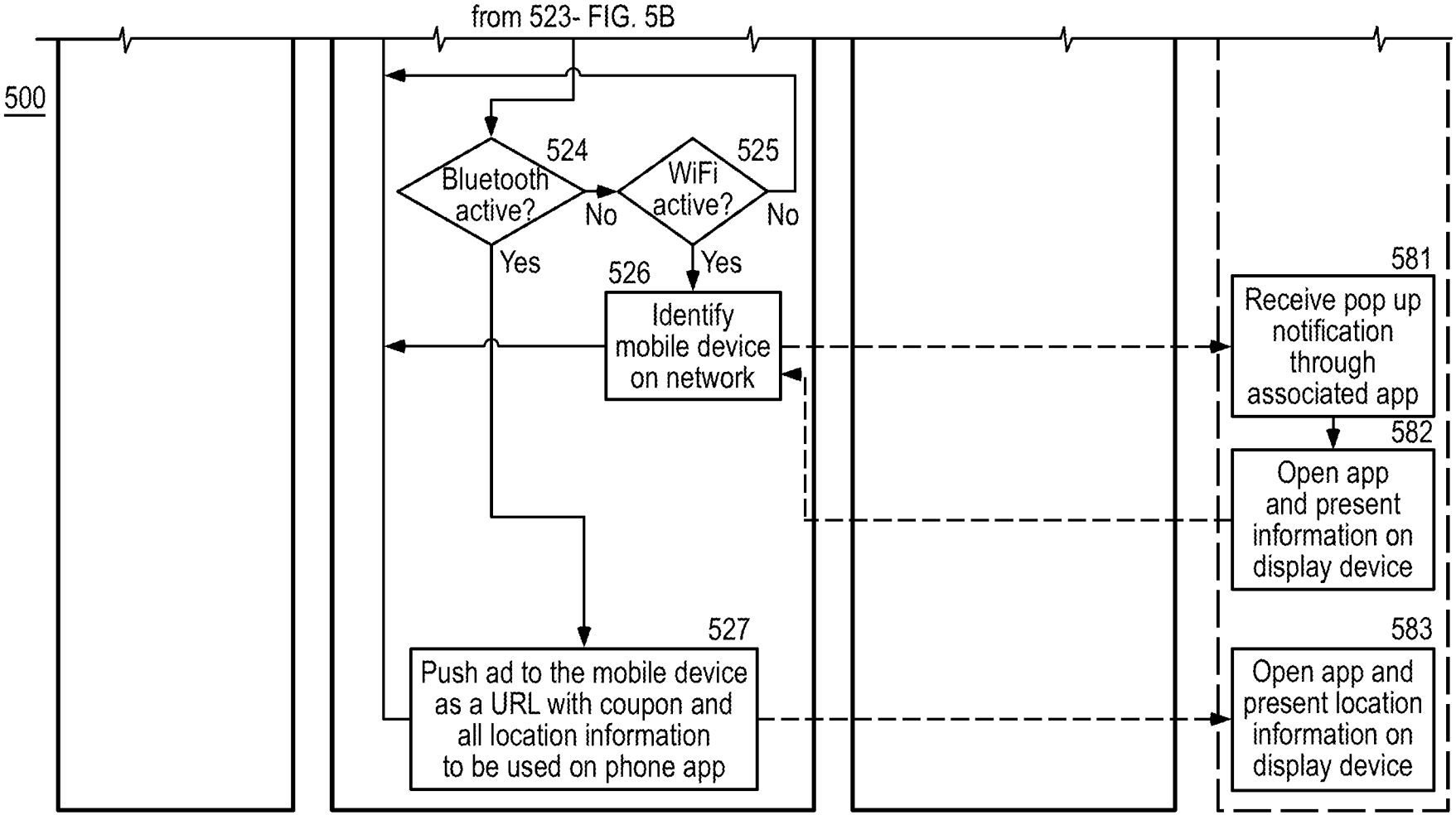

FIGS. 5A-5C provide a flowchart of an example process utilizing a speech-based user interface and indoor navigation service executable by the apparatuses described with reference to FIGS. 1-4B. The following is a process for a person to interact with apparatuses such as those described with reference to FIGS. 1-4B.

The apparatus 510, such as apparatus 300 and 400, may be installed in a premises, such as a grocery store, a retail establishment, a warehouse, an indoor market, shopping mall, or the like. For example, the apparatus 510 may be affixed to a ceiling of the premises and hang into a portion of the premises frequented by persons, such as an entrance way, an end of an aisle, a customer stand or the like. In addition, the apparatus 510 includes a processor coupled via a communication interface (shown in other examples) to an application specific server 540 (shown in other examples) and a voice recognition service (shown in other examples), such as a natural language processing service 560. The natural language processing service 560 may be hosted on a server within the premise or external to the premises. Examples of the natural language processing service 560 are provided, for example, by Google®, Amazon® (e.g., Alexa®), Apple® (e.g., Siri®), Microsoft® (e.g., Cortana®) and others. The process executed by the system 500 is able to interact with persons with and without a mobile device 580. The availability of a mobile device 580 allows the system 500 to provide services, such as discounts, loyalty/affinity program rewards or the like, and/or augmented navigation, such as store map for presentation on display of mobile device, real time navigation updates or the like, in addition to the item location and navigation-related services. At an initial interaction between the apparatus 510 and a person (not shown in this example), the apparatus 510 may begin the process executed by system 500 using speech-related processes provided through a speech-based user interface of the apparatus 510. The apparatus 510 incorporating the speech-based user interface may be used without a mobile device 580.

As shown in FIG. 5A, the apparatus 510 may remain in an idle state (511) when, for example, not in use. In the idle state, the apparatus 510 may be waiting for an input from, for example, a person presence signal indicating the presence of a person in the vicinity of the apparatus 510, such as beneath the apparatus 510, generated by a person detection sensor (e.g., an infrared (IR) detector or the like), or the detection of a phrase or a keyword, such as "Hey, Retail Store Name" or "Where is . . . ?" that triggers the apparatus to exit the idle state.

For example, in response to the detected presence of a person either using a person detection sensor, a mobile device detector, an RF transceiver or detecting via the speech-based user interface a keyword that triggers the speech-based navigation services, the apparatus 510 via a processor may alter a characteristic of the emitted general illumination light, such as continuous light output or white light output, to emphasize a subarea, or specified location, of the area in the vicinity of the apparatus 510. The premises may include signage informing persons that the emphasized subarea is where a person is to stand in order to interact with the apparatus to obtain the speech-based navigation service. As discussed above, the subarea may be directly beneath the apparatus 510 or beneath and to a side of the apparatus 510 (at 512). For example, the sub area may be beneath and to the side of the apparatus 510, if the apparatus 510 were angled and not pointed directly downward. The apparatus 510, at 513, may initiate a timer to determine whether the person is interested in using the system 500 or is not interested (e.g., merely passing by the system 500). For example, the person detection sensor may be configured to continuously detect person's presence for a preset amount of time (e.g., 5 seconds, 10 seconds or the like) as a way to confirm a person's intent to use the apparatus 500. If the person's presence is not detected continuously for the preset amount of time, the apparatus 510 returns to the idle state at 511.

The apparatus 510 may optionally, at 514, alter a characteristic of emitted light, such as changing a composition of the emitted general illumination light directed to the subarea by increasing an amount of one of the colors of red, green or blue, or flashing the emitted general illumination light directed to the subarea to indicate the apparatus's readiness to begin receiving speech inputs usable in the speech-related item location and navigation process.

At 515 of FIG. 5A, the processor, in response to continued detection of the person's presence, may enable microphone(s) of the speech-based user interface coupled to the apparatus 510 as discussed with reference to FIGS. 1-4 to detect sounds in a subarea of the area in the vicinity of the apparatus. In some examples, the subarea may be directly beneath the apparatus, while in other examples, the subarea may still be beneath the apparatus but may be off to a side of the apparatus' center axis. Upon enabling the microphone(s), the apparatus 510, at 516, may output, via a speaker, coupled to the apparatus 510, a speech inquiry, such as a greeting to the user to prompt a request from the user, the speech inquiry intended to be audible only to a person within the subarea. For example, the apparatus 510 may cause a speaker of the speech-based user interface to output an audio greeting and a prompt for assistance, e.g., "May I help you?", "Welcome, what item are you trying to locate?, "I am here to help, tell me what you are looking for." or the like. The speech inquiry may also mention that a coupon or an additional discount and/or additional information is available for download to a user's mobile device, if the mobile device's Bluetooth setting is turned ON.

The process 500 proceeds to FIG. 5B at which a processor (not shown in this example) coupled to the apparatus 510 initiates a record and coded data collection process by the microphone and audio coder at 517. In response to outputting of the audio greeting and/or prompt for assistance, the person may begin to speak and the apparatus 510 processor begins to receive coded data from the audio coder (not shown in this example). For example, upon receipt of a spoken request including, for example, a keyword and an item descriptor within the premises, by the directional microphone (not shown in this example), the apparatus 510 may initiate a voice recognition process.

The apparatus 510 processor may be configured to perform noise cancellation and echo cancellation of any sounds detected outside the specified location, such that the recording and coded data collection at 517 is of only the speech detected from a specified location beneath the apparatus. The apparatus 510 processor forwards, via a communication interface, such as 241 of FIG. 2, the coded data to a natural language processing service 560. The natural language processing service 560 may perform, at 561, a speech recognition process as mentioned above. The speech recognized at 561 may be further processed to identify an intent, at 562, of the recognized speech as a question regarding an item within the premises. The apparatus 510 obtains, via the communication interface, from the natural language processing service 560 a recognition result. This result is intended to merely indicate to the apparatus 510 that the person wishes to use the system 500 to locate an item within the premises. For example, inputs that confirm a person wishes to use the system 500 may include confirmation inputs such as "YES", "SURE", "I WOULD LOVE TO GET HELP" or the like. The system 500 may determine, at 518, from the obtained recognition result that the user intends to continue use the system 500. In which case, the process continues to 519 shown in FIG. 5B. Otherwise, if the user does not intend to continue, the process disables the microphones at 529 and returns to 511 of FIG. 5A at which the apparatus 510 returns to an idle state.

Returning to step 519 of FIG. 5B, the apparatus 510 initiates another record and recognition process in order to obtain a person's inquiry that includes an item identifier. An "item identifier" as used in the present discussion may refer to a stock number (e.g., a premises' proprietary inventory scheme or the like), a universal product code (UPC), an item category (e.g., condiments or coffee), a specific-type of item (e.g., ketchup or mustard, or *Arabica*), a specific brand name of an item, (e.g., "Heinz®", "Gluden®", "Starbucks®" or "Dunkin Donuts®") a slang name for any of the above (e.g., "toppings", "Joe", "java", "DD®" or the like), or any combination of item identifiers. In addition, items identifiers do not have to only reference food products, but may also refer to clothing (e.g., "pants", "jeans", "Levi's®" or the like), store names (e.g., "Gap®", "Apple®", "Best Buy®" or the like), machine parts (e.g., "batteries", "axle", "printer cartridges") or the like. Also, the item identifiers may refer to combinations of all of the above as well as others.

Continuing with the example at step 519, the person may speak an inquiry or request related to the location of an item in the premises, such as "Where are the Cheerios®?" In addition, the system may be connected to the internet, such as network 295 of FIG. 2. Via the connection to the internet, the user interface of apparatus 500 may allow the user to ask general questions about products that may include internal information (e.g. price, number in stock, customer ratings, etc.) or external public information (nutrition value, what it is made of, what it is, other consumer ratings, significance, where it is made, etc.). The microphone and audio coder, respectively, detect and encode the person's inquiry or request as coded data. After collecting the coded data corresponding to person's inquiry/request from the microphone and audio coder, the apparatus 510 forwards, via the communication interface, the coded data to a voice recognition process provided by the natural language processing service 560 for recognition at 563 and the identification of intent at 564. The identification of the intent at 564 may determine whether the recognized speech is in the form of a question or a statement. The voice recognition process when conducting the intent determination at 564 may also incorporate syntactic and semantic analysis to accommodate, for example, different dialects, slang, jargon or different patterns of speech. In addition, the system 500 may react to statements or exclamations related to an emergency (e.g., fire, a person's illness, such as heart attack or fall) or potentially unsafe situation, e.g., a spill in Aisle 4, a leaking pipe or the like). After the intent identification at 564, the recognition result with the identified intent is returned to the apparatus 510 at step 520. The recognition result includes one or more tokens which are keywords related to the inputted speech inquiry/request at 519. For example, a speech input of "Where are the Cheerios?" may return a token including "location" and "Cheerios." Similarly, in another example, the tokens formed after determining the intent of "I wonder what ingredients are in the Campbell's® chicken dumpling soup!" may be, for example, "ingredients", "Campbell's chicken dumpling soup". These could be searched in the local database or the internet. In yet another example, 564 may return "compare", "healthier", "Marie Callender's® Chicken pot pie", and "Banquet Chicken® pot pie" as the tokens in the recognition result for the question "Which one is better for my health, Marie Callender's chicken pot pie or Banquet Chicken pot pie?" The recognition result, in addition to the tokens, may include a time stamp, general product information related to the item name included in the token, such as size, weight, number of products in inventory, expiration dates or the like. The item name tokens (e.g. "Marie Callender's Chicken pot pie" and "Banquet Chicken pot pie") may be stored in a local database so the processor may retrieve information related to the items. The token is a set of keywords or parameters that may be used by the processor to perform a search in the database.

In response to the recognition result from a voice recognition process of the natural language processing service 560 containing tokens that include at least an item identifier, the apparatus 510 may access a database containing a location of the item related to the item identifier within the premises or depending upon the tokens provided in the recognition result, the apparatus 510 may access the internet via a data network, such as 270 in FIG. 2, to obtain information, for example, about the product, about a related place, an item, a landmark, a service or the like, based on the recognition result tokens. For example, at step 520 of FIG. 5B, the apparatus 510 processes the recognition result tokens with the identified item identifier. From step 520, the apparatus 510 processor may forward, via the communication interface, the recognition result containing the item identifier of the person's inquiry or request to the application specific server 540 for resolving the inquiry or request. For example, the application specific server 540 may be associated with the premises. For example, if the premises is a retail establishment, the application specific server 540 may be maintained at the premises. The application specific server 540 may be coupled to a database that is configured with a list of item identifiers (e.g., item 150 of FIG. 1) maintained in inventory at the premises and the specified location (e.g., Bay 1) of items within the premises. Alternatively, the application specific server 540 may be accessible via a data network, such as the Internet, and the database coupled to the application specific server 540 may maintain the inventory of multiple premises and/or establishments.

The application specific server 540 may resolve, at 541, the inquiry and request to generate a database query for a location of an item corresponding to the item identifier(s) in the request. The database may return a query response at 542. The returned query response may include information related to the item and identified item navigation-related information. The query response may include information related to the item(s), such as brand name, size(s) (e.g., 12 ounces, 32 ounces), location(s) of the item(s) in the premises (e.g. aisle 7, end unit A, shelving unit 345, Bay 1). The identified item navigation-related information may include, for example, navigation instructions and landmarks along a path through the premises to the item, to direct the person to the item location in the premises, is forwarded to the apparatus 510. The identified item navigation-related information may include, for example, navigation instructions (e.g., turn left, turn right, walk 5 feet, 6 feet, look up, look down) and landmarks (e.g., support post, an aisle end along a path through the premises to the item, other signs and displays). The navigation instructions enable the person to traverse from the subarea to the location of the item within the premises.

At step 521, the apparatus 510 obtains a location of the identified item in the premises from the application specific server 540. The apparatus 510 may form an inquiry response for speech synthesis by encoding the obtained location of the identified item and navigation-related information as an inquiry response having navigation instructions for output by the apparatus 510 speaker. The encoded inquiry response is forwarded to the apparatus speaker. The audio navigation instructions are output as speech toward the specified location and has an amplitude higher within the specified location than outside the specified location. More specifically, the speaker generates audio information based on the encoded inquiry response, the generated audio information conveying the location of the identified item in the premises and location-related information. The generated audio information is directed to the specified location, and has an amplitude higher within the specified location than outside the specified location. For example, the generated audio information includes the navigation instructions that describe a path through the premises to the identified item location. Alternatively, or in addition, as a graphical output, other devices, such as lighting devices within the premises, may be configured to display directional prompts, such as arrows or flashing lights, or display signage or animated graphics showing a path to the identified item location, or multiple locations if a number of item locations are identified.

At 522, the apparatus 510 may cause the speaker to present an audio prompt audible only to the person in the specified location asking if there is a next question or if further assistance is needed. The processor, at 522, may determine whether another question is being presented by a user. For example, if the apparatus 510 receives a YES response to the audio prompt, the process returns to step 519. If the apparatus 510 receives a NO response to the audio prompt, the process proceeds to step 523. At 523, the apparatus 510 using a radio frequency transceiver, such as a Bluetooth® transceiver, a Wi-Fi transceiver, cellular transceiver or other radio frequency transceiver, or another communication method, such as ultrasonic communications as described above, determines whether a mobile device 580 is detected near (i.e. within a specified area) the person using the apparatus 510. As a note, the process steps 523-527 may occur in parallel with steps 517-522, however, for ease of explanation, the process steps 523-527 are described as occurring serially after steps 517-522.

Returning to the example, if the determination at 523 is NO, a mobile device is not near the person, the process executed by system 500 proceeds to 528 at which the apparatus 528 outputs a farewell to the user. If the determination is YES at 523, the process 500 proceeds to FIG. 5C.

Upon determining at 523 that a mobile device is near the person using the apparatus 510, the apparatus 510 determines at 524 of FIG. 5C whether the mobile device's Bluetooth transceiver is active. If the determination at 524 is NO, the process executed by system 500 proceeds to 525 where the apparatus 510 attempts to determine whether the WiFi transceiver of the mobile device 580 is active. If the determination is NO at 525, the process executed by system 500 proceeds to 528 at which the apparatus 528 outputs a farewell to the user. Alternatively, if, at 525, the determination is YES, the mobile device 580, has an active WiFi connection with a premises' WiFi access point, such as 278 of FIG. 2, the process executed by system 500 proceeds to 526 at which the mobile device 580 is identified on the data communication network. Upon identifying the mobile device 580 on the network, such as 277, the apparatus 510 may forward a notification to the mobile device 580.

At 581, the mobile device 581 receives the notification, and, at 582, an application (e.g., a retail store branded application, loyalty/affinity program, an indoor positioning program, or the like) associated with the premises executing on the mobile device opens and presents information (e.g., discounts, coupons, maps, item information or the like) on a display device of the mobile device 580. After step 582, the process executed by system 500 returns to 526 and proceeds to 528 to deliver a farewell message.

Returning to step 524, the apparatus 510 may send via a low-power RF signal a query, such as a Bluetooth advertisement packet, that is intended for receipt by a mobile device in the specified location or subarea. If a mobile device is present in the subarea and has Bluetooth enabled, the mobile device, such as 580, receives the advertisement packet and may begin a pairing process with the apparatus 510, which indicates that the mobile device's Bluetooth is active. In response to the determination that YES, the Bluetooth is active in the vicinity of the specified area, and the process executed by system 500 proceeds to step 527. At 527, the apparatus 510 may transmit, or "push", a data packet containing a URL for a premises coupon and/or location information with respect to the premises to be used by the mobile device. The location information may include a premises map, item locations within the premises and on the map, and other item-related or premises-related information, e.g., sale item locations or cash register availability. The mobile device 580, in response to receiving the transmitted data packet(s), may launch an application related to the premises (e.g., a retail store specific application, a shopping mall, or the like), to receive the location information, which may be information usable by the application executing on the mobile device. In the example, the premises-related application may be previously installed on the mobile device 580 or the data packet may include information for obtaining the application from the internet or a premises server. The mobile device 580 may also provide information to the apparatus 510 that allows the apparatus 510 to uniquely identify the mobile device 580 and also enables the apparatus 510 to provide information related to the identified item to the mobile device 580. For example, the application executing on the mobile device 580 may provide mobile device identifying information to the apparatus 510 which may be passed to the application specific server 540. The application specific server 540 may use the mobile device identifying information to determine the types of items and conditions for a coupon. The application specific server 540 may deliver to the apparatus 510 coupons, discounts and other item related information. The apparatus 510 upon connecting to the mobile device 580 may present coupons, location information of items, navigation related information and the like via a display device and/or an audio device of the mobile device 580.

Upon delivering the data packets to the mobile device 580, the process executed by system 500 proceeds to 528 at which the apparatus 510 delivers a farewell message to the user.

When the apparatus 510 pushes notifications containing information related to the identified item to the mobile device 580 in the specified location or subarea, the apparatus 510 may deliver, via a low power Bluetooth-compatible transmission detectable only by the mobile device 580 within the subarea. The radio frequency signal when decoded by the mobile device 580 includes the location information that may include navigation instructions having item location information to the mobile device that allows the mobile device to present on the display device a map of the premises and a static presentation of navigation instructions to the identified item. The static presentation of navigation instructions may include the presentation of text directions, such as go to aisle 5, turn right, after the in-aisle display of wheat crackers, look to the right at the shelf about 2 feet from the bottom of the shelves for the identified item (e.g., the Cheerios). Or alternatively, the static presentation may include a map of the premises with a line drawn from the location of the apparatus to the Cheerios. Since the presentation is static, the provided navigation instructions would not show the person's progress toward the identified item. Dynamic navigation systems such visible light communication (VLC) indoor positioning and indoor RF position determination systems, may be used to provide a user with their progress toward the identified item. In another alternative, the navigation instructions may be presented via a mobile device's audio output device.

After delivery of the farewell message at 528 is complete, the apparatus 510 disables the microphones at 529, and proceeds to the idle state 511.

In some examples, the location information delivered to the mobile device 580 includes additional content, such as recipes, (if the item is clothing) matching accessories, other items commonly purchased with identified item (e.g., an oil filter if the identified item is a case of motor oil) or the like. Alternatively or in addition at 527, the apparatus 510 may prompt the person to allow the apparatus to access the person's mobile device to access a loyalty program application executing on the mobile device or access information, such as user preferences or other loyalty program information that may be stored on the mobile device or accessible through the mobile device's connection with an external network (e.g., a cellular network, a Wi-Fi network or the like).

In some instances, there may be difficulty with a person's interaction with the apparatus 510. For example, the apparatus 510 may be configured to detect a person's frustration with the apparatus during the process executed by system 500 based on an analysis of repeated requests by the same person for a particular item. In which case, the system 500 may determine that the person is having difficulty and may trigger a customer service alert to a staff member of the premises to provide personal assistance to the person. Upon resolution of the difficulty, the apparatus 510 may be configured to respond to a communication from the staff member causing the apparatus 510 to return to the idle state at 511, or may respond to a determination that a person is no longer present as in step 513.

The above discussion is only a general description of but one example of a process that may be implemented using the apparatuses described in the discussion of the examples in FIGS. 1-4B.

Figure 6:
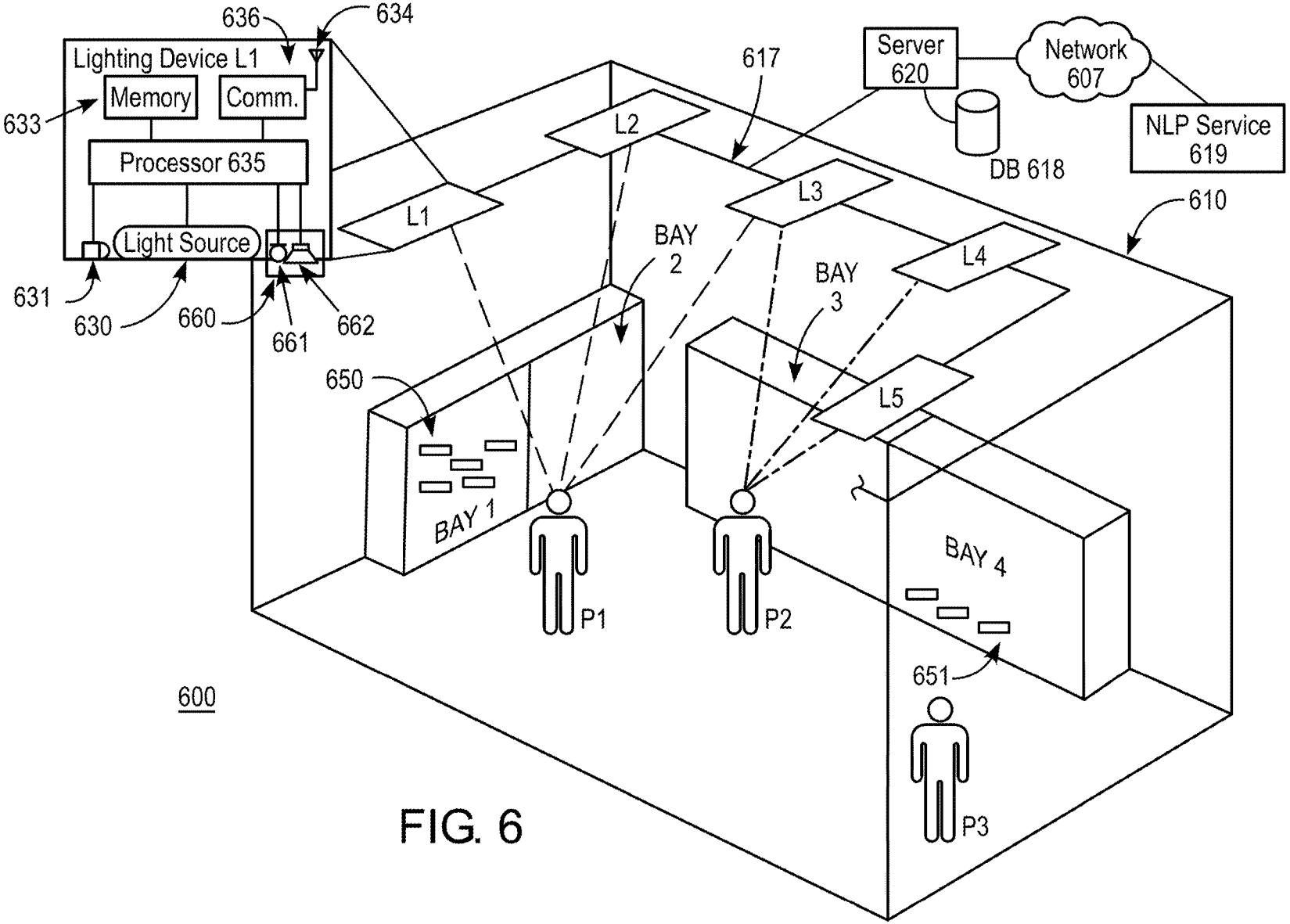
FIG. 6 illustrates a view of another premises in which another example of an apparatus incorporating a speech-based user interface supporting indoor navigation and information services is utilized.

It is contemplated that additional implementations may be provided that utilize different apparatuses than those of FIGS. 1-4B. FIG. 6 illustrates a system view utilizing an array of apparatuses that may also function as lighting devices L1-L5. The system 600 of FIG. 6 is implemented in a premises 610. The premises 610, in this example, is a retail establishment. In this example, each of the lighting devices L1, L2, L3 and L4 is configured as the example lighting device L1. For example, the lighting device L1 includes a general illumination light source 630, an apparatus 660, a processor 635, a memory 633, a person detection sensor 631, a communications interface 636 and an antenna 634.

Each of the apparatuses 660 in this example may operate as a speech-based user interface, which cooperate by using keyword active listening to locate and identify persons requesting speech-based navigation assistance. The apparatus 660 includes a microphone 661 and a speaker 662. The microphone 661 may be an omnidirectional microphone or an array of microphones. The general illumination light source 630 is configured to emit general illumination light for illuminating a space in the premises 610. Each of the remaining lighting devices L2-L5 is configured in a manner similar to lighting device L1, and therefore a detailed discussion of each lighting device will be omitted. However, the person detection sensor 631 may be included as part of the lighting device L1 to provide the additional benefit of providing power management and/or energy conservation features to the system 600. For example, the detection sensor detector 631 may be used in combination with the microphone 661 to provide an indication of whether persons are in the vicinity of the lighting devices L1-L5. Based on the indication that a person is not detected via the detection sensor detector 631, no speech, for example, from a conversation, and/or certain noises generated by a person, such as footsteps, a cart moving down an aisle or the like, is detected via the microphone 661, the respective lighting device light source may be turned OFF or dimmed.

In addition to a number of lighting devices L1-L5, the system 600 includes a premises network 607 and a premises-related server 620. The lighting devices L1-L5 and server 620 may be coupled to the premises network 607. The premises network 607 may also be a lighting-control network that enables control of the light sources of the lighting devices L1-L5. Each of the lighting devices L1-L5 may be commissioned into the lighting-control network. The lighting devices L1-L5 and server 620 may be coupled to detect a keyword based inquiry and output an audio message in response to the detected keyword based inquiry.

Figure 7:
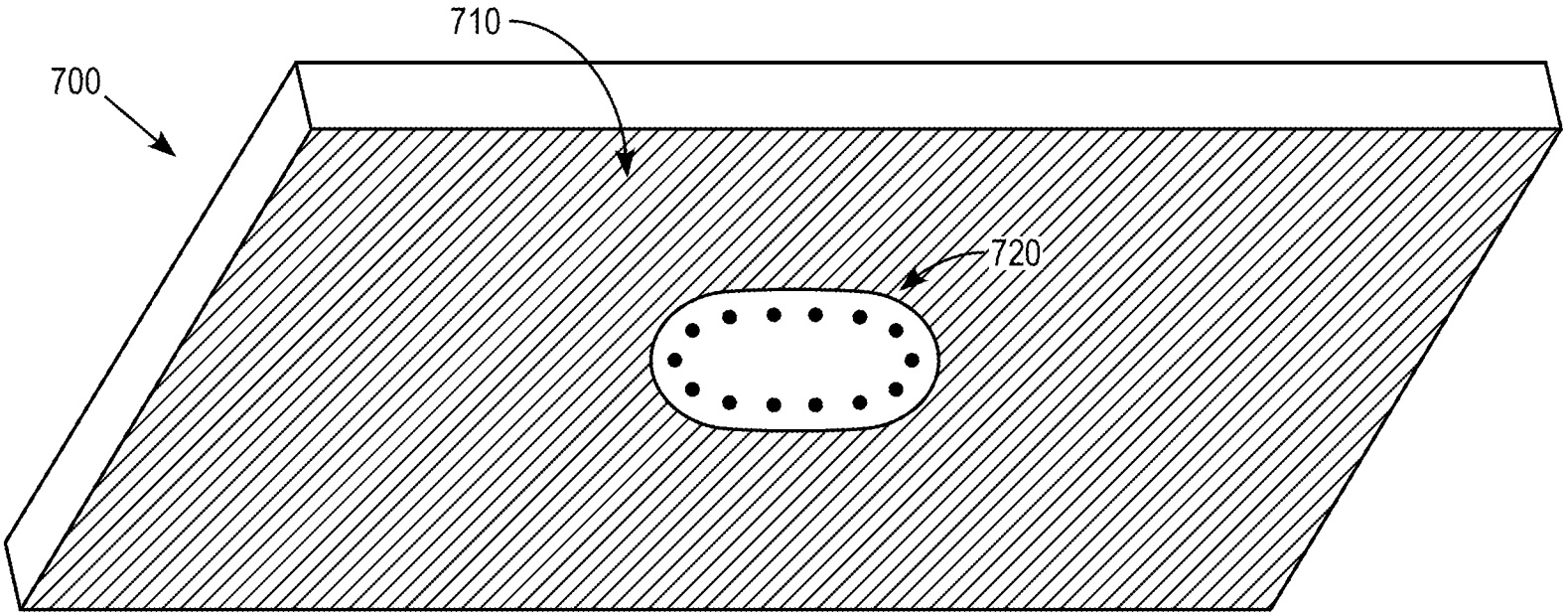
FIG. 7 depicts an example of an apparatus example for providing the speech-based user interface usable in the premises example of FIG. 6.

The lighting devices L1-L5 have a similar hardware configuration as described with reference to earlier examples. However, aspects of the lighting devices L1-L5 may be different. For example, an example of apparatus 660 will be described in more detail with reference to the apparatus 700 of FIG. 7. In the example of FIG. 7, the apparatus 700 includes a radial array of microphones 720 and a controllable parametric speaker 710, such as an ultrasonic transducer array, that may be controlled using directional control signals provided by a processor, such as 635, to accurately direct sound in specific directions and to a specified area, such as a subarea in premises 610. The directed sound having an amplitude higher within the specified area than outside the specified area. The directed sound is intended to only be audible within the specified area.

The radial array of microphones 719 may each detect sound and be coupled to an audio coder that provides the coded sound data to a processor for keyword detection analysis. Keyword detection analysis may be a speech recognition algorithm intended to recognize the utterance of particular set of keywords. Alternatively, each microphone of the radial array of microphones may be coupled to a processor. In this alternative example, the processor is configured to encode the analog signals received from the microphones into encoded sound data. The audio processor is further configured to analyze the encoded sound data from each of the microphones to identify from which direction the detected sound was received. Different forms of such sound data analysis are known, for example, spatial perception, sound localization, blind source separation or the like may be utilized. In addition, the audio processor may also be configured to perform echo cancelation and/or other noise suppression techniques.

A benefit of the apparatus 700 is that the radial array of microphones and controllable speaker permits a person using the speech-related navigation service to move about the premises as compared to hypercardioid microphone in the example of FIG. 4A that is used with a person remaining in the specified location.

For example, the system 600 may perform a speech-related navigation process similar to that described with reference to the process example shown in FIGS. 5A-5C. However, the system 600 operates without the need of having a person remain in a specified location during the interaction with the speech-based navigation service. It may be appropriate at this time to describe an operational example with reference to the example of FIG. 6 and the process flowchart of FIG. 8.

In the operational example, the system 600 including the lighting devices L1-15 and the premises server 620 are located in a premises 610 that is, for example, a "brand name retail store" or the like. The items 650 and 651 may be maintained on shelving bays 1 and 4. Shelving bays 2 and 3 may also store items, but for ease of illustration none are shown. In an alternative example, each of the lighting devices L1-L5 is shown coupled to a server 620 either via a wired or wireless connection. The processor of each lighting device L1-L5 may forward the encoded sound data via the wired or wireless connection to the server 620.

The operation of the system 600 will be described in more detail with reference to the flowchart of FIG. 8 and to the premises 610 of FIG. 6. In the example of FIG. 6, a number of persons P10, P20, and P30 are wandering about the premises 610. The dashed lines indicate which lighting devices are detecting sound, such as speech or utterances from persons P10 (evenly spaced dashed line) and P20 (dash-dot-dashed line), respectively. In contrast to the specified location 120 of premises 110 in the example of FIG. 1, the example of FIG. 6 does not use a preselected subarea, such as 120, within the premises 610.

Figure 8:
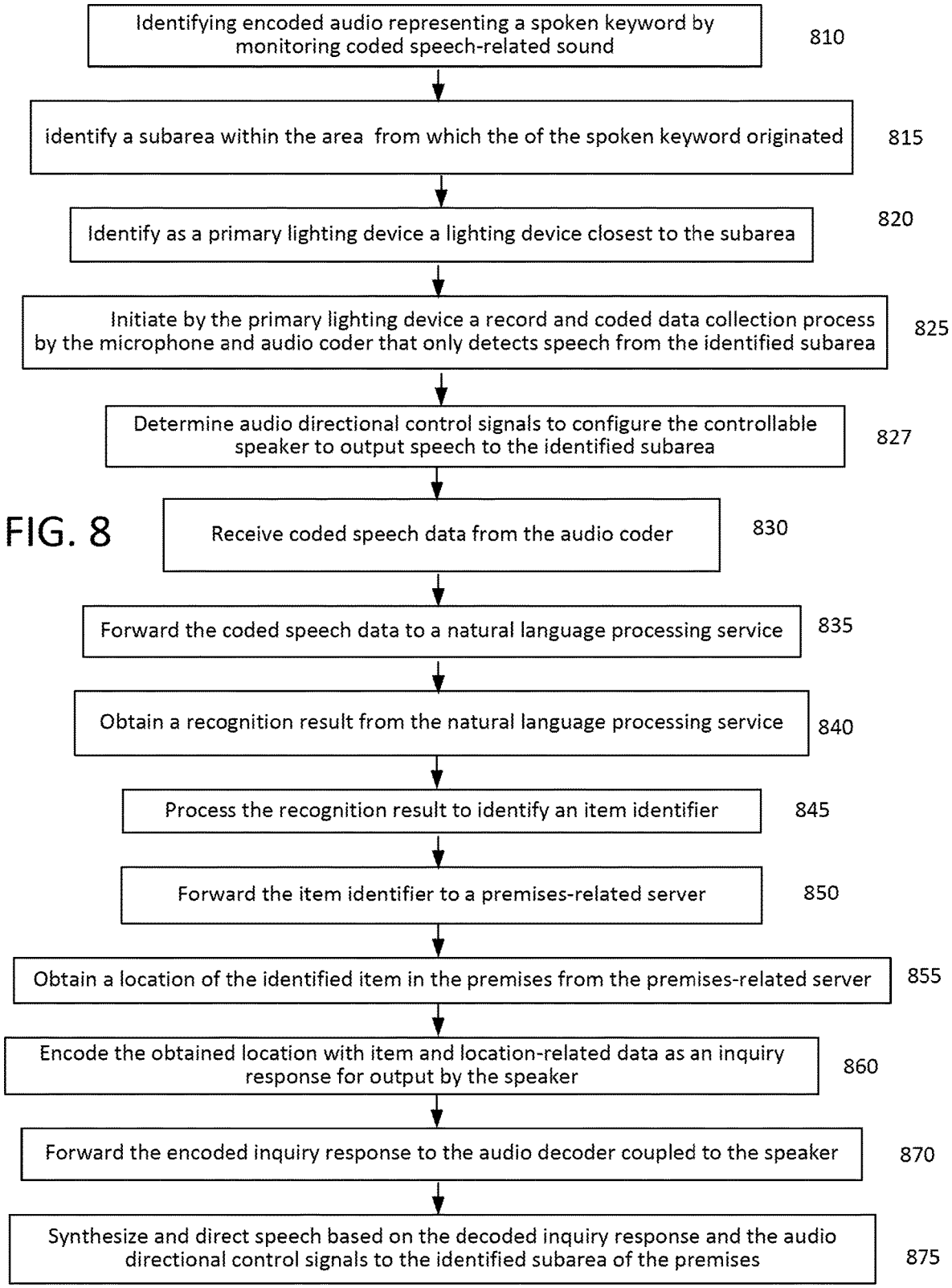
FIG. 8 is a flowchart of an example process utilizing a speech-based user interface for indoor navigation and information services executable by the apparatuses described with reference to FIGS. 6 and 7.

A processor in each of the lighting devices L1-L5 is configured to perform the following process 800 of FIG. 8. The lighting devices L1-L5 are using their microphones in the radial microphone array to perform "active listening" for speech or an utterance containing a keyword. The active listening performed by the microphones of lighting devices L1-L5 may be supplemented by sound detected by microphones strategically placed on the shelves and support posts or other nonintrusive places within the premises to give more spatial information about the speech that is detected. For example, a person such as P10 may want to know where the Cheerios are located. The keyword(s) for initiating the speech-based navigation may be, "Hey [Brand Name Store] !" or "Where is" or the like. Upon identification of encoded speech-related sound data representing a spoken keyword, the processor, at 815 performs a source localization process that identifies within the area of the premises 612 a subarea from which the spoken keyword originated. Examples of source localization include blind source separation and spatial perception and the like.

For example, the processor, such as 635 of lighting device L1 as shown in FIG. 6 may be an audio processor that receives the analog signals from each of the respective microphones in the radial microphone array, and encodes the received audio signals. The processor 635 may be configured to perform a blind source separation algorithm that enables the processor to localize a particular source of speech. Characteristics of the particular source's speech, such as frequency, amplitude, phase and wavelength, may be used to determine a distance from the respective microphones in the radial microphone array of lighting device L1, but also with respect to the lighting devices L2 and L3. As a result, the subarea in the area of the source of the speech may be determined. In addition, other methods such as the time difference of arrival (TDOA) may be used. For example, the sound data containing keywords may also contain information, such as time of arrival or the like, related to when the analog signal from which the sound data was generated was received by the respective microphone in the radial microphone array of each of the respective lighting devices L1-L5.

In addition or alternatively, the server 620 may be configured to receive the encoded sound data from each of the lighting devices L1-L5, and perform a blind source separation algorithm to determine which microphones of the lighting devices L1-L5 detected the keyword.

When a subarea is identified as the location of the source of the spoken keyword, a lighting device that is determined to be closest to the subarea is identified as a primary lighting device of the number of lighting devices (820). For example, the lighting devices may be commissioned into a lighting-control network, and as a result of the commissioning the locations of each of the lighting devices L1-L5 within the premises is known. Based on identified location of the source of the spoken keyword, a lighting device L1-L5 may be selected based on the location of the light device provided during commissioning. Commissioning within the lighting-control network also allows an additional benefit of utilizing the sound detection capabilities of the lighting devices L1-L5 to turn off light sources or dim light sources of lighting devices in areas in which persons are not detected either by noting the lack of conversation or an absence of presence signals output by the person detection sensors. In response to the identification of the primary lighting device, the system 600 establishes responsibility for further processing by the primary lighting device. For example, the person P10 may have been the person who uttered the keyword, and as such lighting device L1, which is closest to person P10 is designated the primary lighting device. When designated as a primary lighting device, the primary lighting device processor performs the communication functions with the person.

In particular, the primary lighting device processor, in response to the source localization process identifying the subarea, initiate a record and coded data collection process by the microphone and audio coder of the primary lighting device that only detects speech from the identified subarea (825). The primary lighting device is provided with the location of the subarea within the area. The location of the subarea may be provided as grid coordinates, latitude and longitude, or the like. The primary lighting device processor may be further configured, to use the location of the subarea to tune the radial microphone array to focus on detecting speech-related sounds from the direction of the subarea. The processor may determine audio direction control signals to configure the controllable speaker to output speech to the identified subarea (827). For example, the audio direction control signals may be used by the processor to tune the ultrasonic transducer array of the speaker to direct all sound output by the speaker toward the subarea, so that the outputted sound has an amplitude that is higher within the subarea than areas outside the subarea. In the space encompassed by the identified subarea, the audio amplitude is sufficiently high to normally be heard by a person currently within that space. In contrast, in a space outside the identified subarea, the audio amplitude is sufficiently low that it normally would not be heard by a person currently within that space.

The subarea may have dimensions such as an approximately 4 feet by 4 feet area or smaller, such as an approximately 2 feet by 2 feet area. The subarea is not limited to being square, but may also be rectangular, circular, or another shape. For example, the subarea may be circular with a diameter of approximately 3 feet, or the like. The foregoing dimensions are only examples, and the actual size of the subarea depends on various factors, such as the distance the subarea is away from a particular lighting device, the angles between the lighting device and the subarea, configuration of shelving, and the like. In this configuration, the primary lighting device processor proceeds to execute a process similar to that described with reference to FIGS. 5A-5C.

For example, person P10 speaks a request, such as "In what aisle are the Cheerios located?" The processor of the primary lighting device (i.e. L1) receives coded speech data from the audio coder or audio processor coupled to the radial microphone array (830). The coded speech data is forwarded (at 835), via the communication interface, such as 636 of FIG. 6, of the primary lighting device, the coded speech data to a natural language processing service, such as 619 of FIG. 6. In this example, the natural language processing service may be provided by the premises-related server 620.

The primary lighting device obtains, via the communication interface, a recognition result from the natural language processing service (840). The processor of the primary lighting device processes the recognition result to identify an item identifier in the recognition result (845). Upon identifying the item identifier, the processor may forward the item identifier to a premises-related server (850). The premises-related server may access a database, such as 618, to retrieve information related to the item identifier, and returns the item identifier information. The item identifier information may include a stock number or UPC of the item, an item description (e.g., size, shape, packaging type, such as can, bottle, box, or the like), and/or the item location expressed in grid coordinates, aisle and bay or shelf number, latitude and longitude or the like. The primary lighting device processor obtains at a location of the identified item in the premises from the item identifier information provided premises-related server (855).

At 860, the obtained location with item and location-related data is encoded by the processor as an inquiry response for output by the speaker. For example, the processor encodes the obtained location with item and location-related data as an inquiry response for output by the speaker. The location-related data may include navigation instructions to provide the person in the subarea with directions to the item location. The navigation instructions indicate a path through the premises to the identified item location. The encoded inquiry response is forwarded to the audio decoder coupled to the speaker of the primary lighting device (870) for decoding and application to the speaker. The speaker of the primary lighting device generates audio output including speech based on the decoded inquiry response and the audio directional control signals (875). For example, the inquiry response may be presented to the person in the subareas as speech in the form of a spoken message. The generated audio (i.e. speech) is output, via the speaker's directional output capabilities, in a manner substantially limited to the identified subarea of the premises. The generated audio speech output by the speaker is substantially limited to the identified subarea. The generated audio speech has a higher amplitude within the identified subarea than outside the identified subarea. As a result, the chances of distracting others persons, such as P20 near the identified area around P10 are mitigated, and the user P10 has some privacy with regard to their inquiry. For example, the spoken message may state as speech to the identified subarea, "The ketchup that you requested in located is in aisle 9, please turn right, walk past 3 aisles, turn left into aisle 9 after pass the end display of baby food. Once in aisle 9 walk to the shelves with pickles on the right-hand side, and the ketchup will be to the left of the pickles at the second shelf from the top. Should you need further assistance, please let us know." Of course, the inquiry response may contain information for generating different forms of spoken messages or combinations of pre-arranged inquiry response messages.

Figure 9:
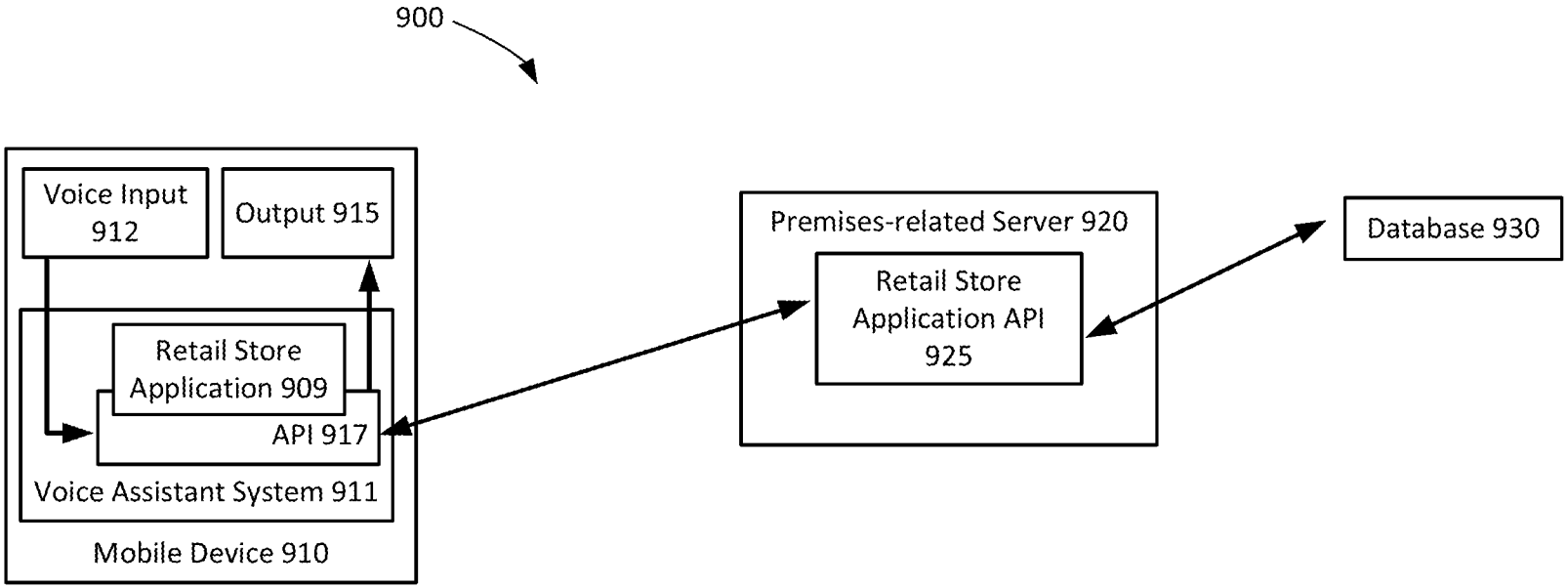
FIG. 9 is a simplified functional block diagram of a mobile or wearable device example of the speech-based user interface for indoor navigation and information services.

FIG. 9 illustrates a functional block diagram of an example of a mobile or wearable device that interacts with the premises-related server. The system 900 includes a mobile device 910, a premises-related server 920 and a database 930. A user of the mobile device 910 may find themselves in need of assistance in locating a particular item with a premises, such as premises 610 of FIG. 6. Instead of using the apparatus based speech-related navigation service described with reference to the examples of FIGS. 1-8, the user decides to use a mobile device based speech-related navigation service similar to that described with reference to the earlier examples.

In the example of FIG. 9, the mobile device 910 and the premises-related server 920 may communicate via a wireless radio frequency (RF) connection. The wireless (RF) connection may be one or more of a local area network (LAN) with a premises, a cellular network or a short-range RF network, such as a Bluetooth network. For example, the mobile device 910 may include a voice assistant system 911, such as Siri, Cortana, OK Google or the like, a voice input 912, such as a microphone coupled to an audio coding circuit, and an output 915, such as a speaker, a display device, pulse or vibration output or the like. The mobile device 910 may communicate via an application programming interface (API) 917 with a retail store application API 925 executing on the premises-related server 920. The premises-related server 920 may be coupled to the database 930, which stores the location of items in premises.

In an operational example, the mobile device 910 has a processor that executes a retail store application 909. The retail store application 909 receives via the voice input 912 a request spoken by a user of the mobile device 910. The retail store application 909 utilizes the voice assistant system 911 which may be an available natural language processing service, such as Ski, Cortana, OK Google or the like to recognize the spoken request. The voice assistant system 911 provides a recognition result to the retail store application 909. The retail store application 909 may parse the recognition result to locate an item identifier, and may forward the item identifier to the API 917. The API 917 forwards, via a wireless connection, the item identifier to a retail store application API 925 executing on the premises-related server 920. Retail store application API 925 may enable the premises-related server 920 to couple to the database 930. The database 930 may store information related to the premises in which the mobile device 910 is located. In response to receiving the item identifier, the retail store application API 925 may forward a request for location-related data related to the item identifier. The database 930 may return the location-related data corresponding to the item identifier to the premises-related server 920. The premises-related server 920 forwards the location-related data to the mobile device 910. The retail store application 909, in response receiving the location-related data, may process the location-related data to generate navigation instructions for output from the output 915 of the mobile device 910. The navigation instructions may be text-based instructions, speech-related instructions, or map-based for output on one or more of the mobile device's outputs 915.

Figure 11:
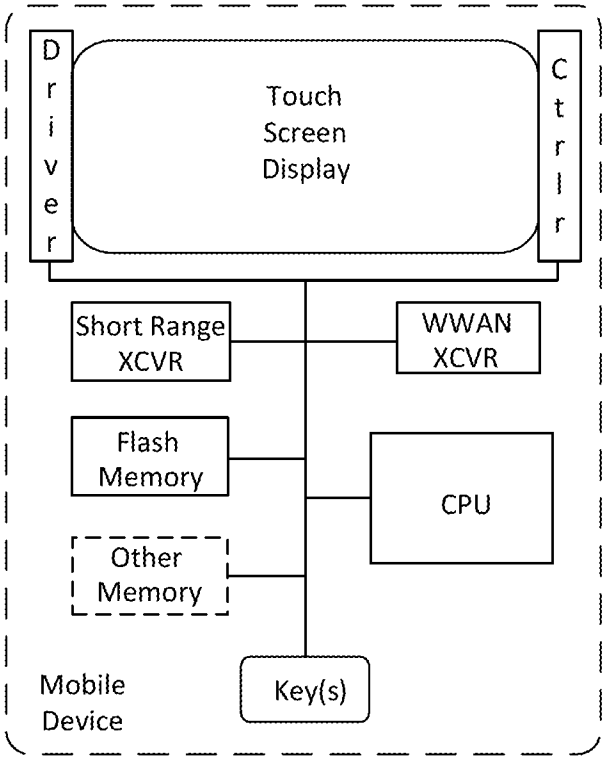
FIG. 11 is a simplified functional block diagram of a mobile device, as an alternate example of a user terminal device, for possible communication in or with the system of FIG. 1 or 6.
Figure 10:
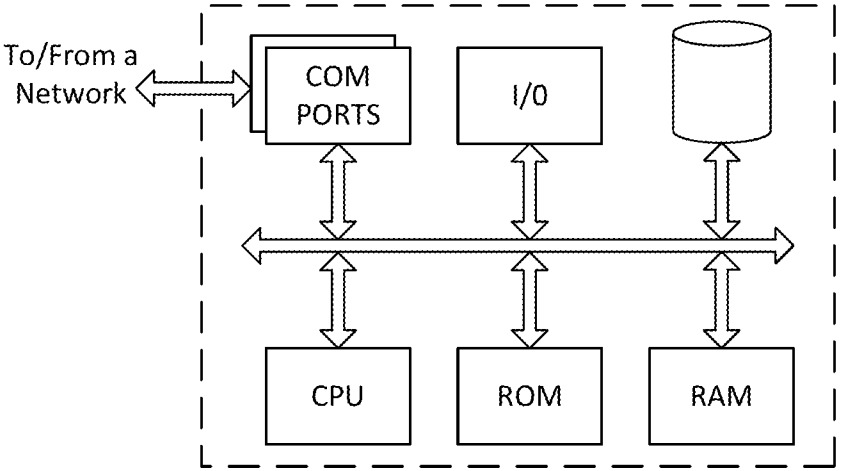
FIG. 10 is a simplified functional block diagram of a computer that may be configured as a host or server, for example, to function as the external server or a server if provided at the premises in the system of FIG. 1 or 6.

As shown by the above discussion, at least some functions of devices associated or in communication with the networked system 600 of FIG. 6, such as elements shown at 620 and 619 (and/or similar equipment not shown but located at the premises 610), may be implemented with specifically-programmed general purpose computers or other specifically-programmed general purpose user terminal devices, although special purpose devices may be used. FIGS. 10 and 11 provide functional block diagram illustrations of exemplary hardware platforms for enabling specifically-programmed computer or terminal device functions as described herein.

FIG. 10 illustrates a network or host computer platform, as may typically be used to implement a host or server, such the server 620 or 920. The block diagram of a hardware platform of FIG. 11 represents an example of a mobile device, such as a tablet computer, smartphone or the like with a network interface to a wireless link. It is believed that those skilled in the art are familiar with the structure, programming and general operation of such computer equipment and as a result the drawings should be self-explanatory.

A server (see e.g. FIG. 10), for example, includes a data communication interface for packet data communication via the particular type of available network. The server also includes a central processing unit (CPU), in the form of one or more processors, for executing program instructions. The server platform typically includes an internal communication bus, program storage and data storage for various data files to be processed and/or communicated by the server, although the server often receives programming and data via network communications. The hardware elements, operating systems and programming languages of such servers are conventional in nature, and it is presumed that those skilled in the art are adequately familiar therewith. Of course, the server functions may be implemented in a distributed fashion on a number of similar platforms, to distribute the processing load.

A mobile device (see FIG. 11) type user terminal may include similar elements, but will typically use smaller components that also require less power, to facilitate implementation in a portable form factor. The example of FIG. 11 includes a wireless wide area network (WWAN) transceiver (XCVR) such as a 3G or 4G cellular network transceiver as well as a short range wireless transceiver such as a Bluetooth and/or WiFi transceiver for wireless local area network (WLAN) communication. The mobile device does not have to be configured with all of the components shown in FIG. 11. For example, the mobile device may also be a smartwatch, a wireless headset, augmented reality glasses, or the like, that may have less than all or all of the components shown in FIG. 11. The computer hardware platform of FIG. 10 is shown by way of example as using a RAM type main memory and a hard disk drive for mass storage of data and programming, whereas the mobile device of FIG. 11 includes a flash memory and may include other miniature memory devices. It may be noted, however, that more modern computer architectures, particularly for portable usage, are equipped with semiconductor memory only.

The mobile device example in FIG. 11 includes a touch-screen type display, where the display is controlled by a display driver, and user touching of the screen is detected by a touch sense controller (Ctrlr). The hardware elements, operating systems and programming languages of such computer and/or mobile user terminal devices also are conventional in nature, and it is presumed that those skilled in the art are adequately familiar therewith.

Program aspects of the technology discussed above may be thought of as "products" or "articles of manufacture" typically in the form of executable code and/or associated data (software or firmware) that is carried on or embodied in a type of machine readable medium. "Storage" type media include any or all of the tangible memory of the computers, processors or the like, or associated modules thereof, such as various semiconductor memories, tape drives, disk drives and the like, which may provide non-transitory storage at any time for the software or firmware programming. All or portions of the programming may at times be communicated through the Internet or various other telecommunication networks. Such communications, for example, may enable loading of the software from one computer or processor into another, for example, from a premises-related server into the apparatus 200 of FIG. 2, including both programming for individual element functions, such as audio encoding and decoding, response messages and the like. Thus, another type of media that may bear the software/firmware program elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

The term "coupled" as used herein refers to any logical, physical or electrical connection, link or the like by which signals produced by one system element are imparted to another "coupled" element. Unless described otherwise, coupled elements or devices are not necessarily directly connected to one another and may be separated by intermediate components, elements or communication media that may modify, manipulate or carry the signals.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. It is intended by the following claims to claim any and all modifications and variations that fall within the true scope of the present concepts.

What is claimed is:

1. An apparatus, comprising:

a general illumination light source configured to emit general illumination light for illuminating a space of a premises;

a person detection sensor responsive to a person in a specified location of a vicinity of the apparatus;

a speech-based user interface, comprising:

a microphone with an audio coder that detects speech-related audio inputs from a source of speech; and a controllable speaker with an audio decoder, the speaker being configured to output an audio message in a specified direction toward the source of speech;

a communication interface configured to be coupled to a data network and an application server;

a memory storing programming instructions;

a processor, coupled to the general illumination light source, the audio coder, the audio decoder, the communication interface, and the memory, wherein the processor upon executing the programming instructions stored in the memory configures the apparatus to perform functions, including the functions to:

enable the microphone and audio coder in response to a signal generated by the person detection sensor;

output an audio greeting or prompt via the controllable speaker;

initiate a record and coded data collection process by the microphone and audio coder for the detected audio inputs of a user of the interface at the specified location beneath the apparatus;

receive coded data from the audio coder, forward, via the communication interface, the coded data to a natural language processing service for recognition of the coded data;

obtain a recognition result, via the communication interface, from the natural language processing service;

process the recognition result to provide an item identifier of an item corresponding to the coded data and located within the premises of the light source;

forward the item identifier, via the communication interface, to an application server;

obtain a location of the identified item in the premises and navigation-related information to the location of the item within the space illuminated by the light source, via the communication interface, from the application server; and encode the obtained location of the identified item and navigation-related information for guidance to the location of the item into an inquiry response for output to the user of the interface.

2. The apparatus of claim 1, wherein the processor is further configured to perform the function to:

forward the encoded inquiry response to the decoder to drive the speaker; and generate by the speaker audio information based on the encoded inquiry response, the generated audio information conveying the location of the identified item in the premises and navigation-related information, wherein:

the generated audio information is directed to the specified location, and has an amplitude higher within the specified location than outside the specified location.

3. The apparatus of claim 2, wherein the generated audio information includes audio directions based on the navigation-related information, the audio directions including navigation instructions that describe a path through the premises to the identified item location.

4. The apparatus of claim 1, wherein:

the person detection sensor is coupled to the processor, and the person detection sensor is one or more of an ultrasonic device, a wireless RF device, or an infrared sensor.

5. The apparatus of claim 4, wherein the processor is configured to:

in response to receiving a person detection signal, generate a prompt from the speaker as to whether the detected person wants the encoded inquiry response output as a voice message from the speaker or to a mobile device via a radio frequency transceiver.

6. The apparatus of claim 1, wherein the processor is configured to:

in response to receiving the signal generated by the person detection sensor, alter a characteristic of the general illumination light emitted by the general illumination light source, the altered general illumination light characteristic indicating the location of the apparatus in the space.

7. The apparatus of claim 1, wherein the microphone comprises:

a primary hypercardioid microphone that is a directional microphone, and an array of secondary microphones coupled about an exterior of the apparatus.

8. The apparatus of claim 1, wherein the apparatus further comprises:

a radio frequency transceiver configured to communicate with a mobile device in the specified location; and wherein the processor is further configured to perform a function to:

provide via the radio frequency transceiver static indoor navigation instructions to the mobile device, the static indoor navigation based on a map of the premises, the location of the apparatus within the premises, and the location of the identified item.

9. The apparatus of claim 8, wherein the radio frequency transceiver is coupled to an antenna, and the radio frequency transceiver is configured to emit signals at a power setting at which the power of the emitted signals is higher in the specified location than outside the specified location.

10. A method, comprising:

enabling a directional microphone of a speech-based user interface in response to a signal generated by detection of a sound in a subarea defined beneath a lighting device in an area in which the lighting device is located, the speech-based user interface incorporated in the lighting device;

processing the detected sound to identify speech-related sound from the subarea;

outputting, via a speaker of the speech-based user interface, a speech prompt, the speech prompt audible to a person within the subarea, wherein the speech prompt is output from the speaker as speech that has an audio amplitude higher within the subarea than outside the subarea;

upon receipt by the directional microphone of a spoken request from the person that is responsive to the speech prompt, initiating a voice recognition process based on the spoken request of the person, wherein the spoken request includes an item identifier of an item located within a premises of the lighting device;

in response to an output result of the voice recognition process processing the spoken request including the item identifier, accessing a database containing a location of the item within the premises of the lighting device and corresponding to the item identifier; and based on information in the database, providing, via a speaker of the speech-based user interface, navigation instructions to the location of the item corresponding to the item identifier and spoken request of the person to enable traversal by the person from the subarea defined beneath the lighting device to the location of the item within the premises of the lighting device, wherein the navigation instructions are provided as speech that has an audio amplitude higher within the subarea than outside the subarea.

11. The method of claim 10, wherein the enabling of the directional microphone of the speech-based user interface is in response to continued detection of person's presence in the subarea.

12. The method of claim 10, wherein processing the detected sound to identify speech in the detected sound, comprises:

applying a source separation audio process to the detected sound to identify only speech, obtaining speech data related to the identified speech;

selecting data related to the spoken prompt, and forwarding the selected data to a processor for delivery to the audio output device.

13. The method of claim 10, wherein providing navigation instructions enabling traversal by the person from the subarea to the location of the item within the premises, comprises:

delivering, via a low power radio frequency transmission, a radio frequency signal containing navigation instructions to a mobile device, wherein the radio frequency signal detectable only by the mobile device within the subarea.

14. The method of claim 10, further comprising:

in response to detecting a presence of a person beneath the lighting device, generating a person presence signal; and in response to the generated person presence signal, altering a characteristic of the emitted general illumination light to illuminate the subarea indicating the speech-based user interface is ready to receive speech inputs.

15. The method of claim 14, wherein altering a characteristic of the emitted general illumination light, comprises:

changing a composition of the emitted general illumination light directed to the subarea by increasing an amount of one of the colors of red, green or blue.

16. The method of claim 14, wherein altering a characteristic of the emitted general illumination light, comprises:

flashing the emitted general illumination light directed to the subarea.

17. A system, comprising:

a premises-related server configured to provide information related to identified items within a premises;

a natural language processing service coupled to communicate with the premises-related server via a data network, the natural language processing service providing recognition results in response to receipt of coded speech data; and a number of lighting devices coupled to the premises-related server, each lighting device of the number of lighting devices including:

a general illumination light source configured to emit general illumination light for illuminating an area of a premises;

a person detection sensor responsive to a person in a specified location of a vicinity of the number of lighting devices;

a speech-based user interface, including:

a microphone coupled to an audio coder that, in response to a signal generated by the person detection sensor, detects speech-related audio inputs from a source of speech in the specified location; and a controllable speaker coupled to an audio decoder, the speaker being configured to output an audio message in a specified direction for presentation to the source of speech;

a communication interface configured to enable communications of the respective lighting device via the data network;

a memory storing programming instructions;

a processor, coupled to the general illumination light source, the audio coder, the audio decoder, the communication interface, and the memory, wherein the processor upon executing the programming instructions stored in the memory configures the lighting device to perform functions, including the functions to:

monitor coded speech-related sound data provided by the audio coder based on speech-related sound detected by the microphone;

upon identification of encoded speech-related sound data representing a spoken keyword, perform a source localization process that identifies within the area a subarea of the premises from which the spoken keyword originated;

identify a primary lighting device of the number of lighting devices as being closest to the subarea;

in response to the identification of the primary lighting device, establish responsibility for further processing by the primary lighting device;

wherein when a lighting device is established as the primary lighting device, the processor of the primary lighting device is further configured to:

in response to the source localization process identifying the subarea, initiate a record and coded data collection process by the microphone and audio coder of the primary lighting device for the detected speech-related audio inputs in the identified subarea of the premises;

receive coded speech data from the audio coder of the primary lighting device, the coded speech data based on speech originating from the identified subarea;

forward, via the communication interface of the primary lighting device, the coded speech data to the natural language processing service;

obtain, via the communication interface of the primary lighting device, a recognition result from the natural language processing service;

process the recognition result to provide an item identifier of an item corresponding to the coded data and located within the vicinity of the lighting devices;

forward the item identifier to the premises-related server via the communication interface of the primary lighting device;

obtain a location of the identified item in the premises and navigation-related information from the premises-related server to the location of the identified item within the premises illuminated by the light source via the communication interface of the primary lighting device;

encode the obtained location with item and location-related data as an inquiry response for output by the speaker of the primary lighting device, the encoded inquiry response including an encoded audio response message for output as speech to the person in specified location;

determine audio directional control signals to configure the controllable speaker of the primary lighting device to output speech substantially limited to the identified subarea;

forward the encoded inquiry response to the audio decoder coupled to the speaker of the primary lighting device, the audio decoder decoding the encoded inquiry response; and generate audio output by the speaker of the primary lighting device including speech based on the decoded inquiry response and the audio directional control signals, the generated audio output being substantially limited to the identified subarea of the premises.

18. The system of claim 17, wherein the controllable speaker of each of the number of lighting devices is a steerable ultrasonic array, the steerable ultrasonic array being configured to be responsive to:

the encoded inquiry response to be output as component ultrasonic sounds forming the generated audio, and the audio directional control signals to direct the component ultrasonic sounds to the subarea of the area in proximity to the primary lighting device wherein the component ultrasonic sounds are combined as speech having an amplitude higher within the subarea than outside the subarea.

19. The system of claim 17, wherein the controllable speaker of each of the number of lighting devices is a parametric speaker, the parametric speaker being configured to be responsive to:

the encoded inquiry response to output speech, and the audio directional control signals to direct the outputted speech to the subarea of the area in proximity to the primary lighting device.

20. The system of claim 17, further comprising:

a premises communication data network within the premises coupled to the premises-related server and each of the number of lighting devices, wherein:

the premises communication data network configured as a wired and/or wireless network within the premises, and is coupled to the data network; and a database coupled to the premises-related server, wherein the database is configured to store locations in the premises of all items in an inventory.

21. The system of claim 17, further comprising a mobile device, the mobile device including:

a memory storing program code of a premises-related application and a voice assistant system;

a radio frequency transceiver configured to provide a wireless RF connection with a premises-related server configured to provide information related to identified items within a premises;

a microphone with an audio coding circuit;

an output device; and a processor, upon execution of the program code of the application and voice assistant system stored in the memory, being configured to:

receive an input from the audio coding circuit;

generate by the voice assistant system a recognition result from an output of the audio coding circuit parse the recognition result into information related to an item;

forward the item related information to the premises-related server;

receive item location-related data from the premises-related server, wherein the item location-related data is based on the premises; and in response to receiving the item location-related data, generate instructions to navigate through the premises to a location of the item, based on the item location-related data; and output the generated navigation instructions from the output device of the mobile device.

22. The system of claim 21, wherein the application is a premises-related application.

23. A mobile device, comprising:

a memory storing program code of a premises-related application and a voice assistant system;

a radio frequency transceiver configured to provide a wireless RF connection with a premises-related server configured to provide information related to identified items within a premises;

a person detection sensor configured to detect a person in a specified location of a vicinity of the mobile device;

a microphone with an audio coding circuit, wherein the microphone is enabled in response to a signal generated by the person detection sensor;

an output device; and a processor, upon execution of the program code of the premises-related application and the voice assistant system stored in the memory, being configured to:

receive an input from the audio coding circuit;

generate by the voice assistant system a recognition result from the input received from the audio coding circuit;

parse the recognition result to provide the information related to the identified item located within the premises;

forward the information related to the identified item to the premises-related server;

receive item location-related data of the identified item from the premises-related server, wherein the item location-related data is based on the identified item within the premises; and in response to receiving the item location-related data of the identified item, generate instructions to navigate the person through the premises to a location of the identified item, based on the item location-related data; and output the generated navigation instructions from the output device of the mobile device.

24. The mobile device of claim 23, wherein the output device is a display device; and the processor is further configured, when outputting the generated navigation instructions from the output device to perform functions, including functions to:

output the generated navigation instructions as text-based navigation instructions to the item location on the display device.

25. The mobile device of claim 23, wherein the output device is a display device; and the processor is further configured, when outputting the generated navigation instructions from the output device to perform functions, including functions to:

output the navigation instructions as map-based navigation instructions to the item location on the display device.

26. The mobile device of claim 23, wherein the output device is a speaker; and the processor is further configured, when outputting the generated navigation instructions from the output device to perform functions, including functions to:

output the navigation instructions as speech-related navigation instructions to the item location via the speaker.

27. The apparatus of claim 1, wherein the output from the user of the interface is at least one of an audio output or a graphical output.

28. The method of claim 10, wherein the navigation instructions to the location of the item corresponding to the spoken request further includes a graphical output.

29. The system of claim 17, wherein the generated audio output is further processed to provide a graphical output.

* * * * *